US011649526B2

(12) United States Patent
Sherman et al.

(10) Patent No.: US 11,649,526 B2
(45) Date of Patent: May 16, 2023

(54) DEGRADABLE METAL MATRIX COMPOSITE

(71) Applicant: TERVES, LLC, Euclid, OH (US)

(72) Inventors: Andrew J. Sherman, Mentor, OH (US); Nicholas Farkas, Euclid, OH (US); David Wolf, Euclid, OH (US)

(73) Assignee: TERVES, LLC, Euclid, OH (US)

( * ) Notice: Subject to any disclaimer, the term of this patent is extended or adjusted under 35 U.S.C. 154(b) by 520 days.

(21) Appl. No.: 16/997,286

(22) Filed: Aug. 19, 2020

(65) Prior Publication Data

US 2020/0385842 A1 Dec. 10, 2020

Related U.S. Application Data

(62) Division of application No. 16/045,924, filed on Jul. 26, 2018, now Pat. No. 10,865,465.

(Continued)

(51) Int. Cl.

| | |
|---|---|
| ***C22C 1/10*** | (2023.01) |
| ***C22C 29/02*** | (2006.01) |
| ***C22C 47/04*** | (2006.01) |
| ***C22C 32/00*** | (2006.01) |
| ***C22C 23/00*** | (2006.01) |

(Continued)

(52) U.S. Cl.

CPC ..... *C22C 1/1068* (2013.01); *C22C 1/047* (2023.01); *C22C 1/101* (2013.01); *C22C 1/1036* (2013.01); *C22C 21/00* (2013.01); *C22C 23/00* (2013.01); *C22C 29/02* (2013.01); *C22C 29/06* (2013.01); *C22C 29/12* (2013.01); *C22C 29/14* (2013.01); *C22C 29/16* (2013.01); *C22C 29/18* (2013.01); *C22C 32/0036* (2013.01); *C22C 32/0052* (2013.01); *C22C 32/0057* (2013.01); *C22C 32/0063* (2013.01); *C22C 32/0068* (2013.01); *C22C 32/0073* (2013.01); *C22C 32/0078* (2013.01); *C22C 47/04* (2013.01);

(Continued)

(58) Field of Classification Search

CPC ..... C22C 1/047

See application file for complete search history.

(56) References Cited

U.S. PATENT DOCUMENTS

| | | | |
|---|---|---|---|
| 1,468,905 | A | 7/1923 | Herman |
| 1,558,066 | A | 10/1925 | Veazey et al. |
| 1,880,614 | A | 10/1932 | Wetherill et al. |
| 2,352,993 | A | 7/1933 | Albertson |

(Continued)

FOREIGN PATENT DOCUMENTS

| | | |
|---|---|---|
| CA | 2783241 | 6/2011 |
| CA | 2783346 | 6/2011 |

(Continued)

OTHER PUBLICATIONS

Scharf et al., "Corrosion of AX 91 Secondary Magnesiunm Alloy", Advanced Engineering Materials, vol. 7, No. 12, pp. 1134-1142 (2005).

(Continued)

*Primary Examiner* — Christopher S Kessler

(74) *Attorney, Agent, or Firm* — Ulmer & Berne LLP; Brian E. Turung

(57) ABSTRACT

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations.

30 Claims, 6 Drawing Sheets

Related U.S. Application Data

(60) Provisional application No. 62/537,707, filed on Jul. 27, 2017.

(51) Int. Cl.

| | |
|---|---|
| ***C22C 21/00*** | (2006.01) |
| ***C22C 29/06*** | (2006.01) |
| ***C22C 29/18*** | (2006.01) |
| ***C22C 49/04*** | (2006.01) |
| ***C22C 29/16*** | (2006.01) |
| ***C22C 47/12*** | (2006.01) |
| ***C22C 29/14*** | (2006.01) |
| ***C22C 29/12*** | (2006.01) |
| ***C22C 1/047*** | (2023.01) |

(52) U.S. Cl.
CPC ..... *C22C 47/12* (2013.01); *C22C 49/04* (2013.01); *C22C 1/1073* (2023.01)

(56) References Cited

U.S. PATENT DOCUMENTS 2,011,613 A 8/1935 Brown et al.
2,094,578 A 10/1937 Blumenthal et al.
2,189,697 A 2/1940 Baker
2,222,233 A 11/1940 Mize
2,225,143 A 12/1940 Baker et al.
2,238,895 A 4/1941 Gage
2,261,292 A 11/1941 Salnikov
2,294,648 A 9/1942 Ansel et al.
2,301,624 A 11/1942 Holt
2,394,843 A 2/1946 Cook et al.
2,672,199 A 3/1954 McKenna
2,753,941 A 7/1956 Hebard et al.
2,754,910 A 7/1956 Derrick et al.
2,933,136 A 4/1960 Ayers et al.
2,983,634 A 5/1961 Budininkas et al.
3,057,405 A 10/1962 Mallinger
3,066,391 A 12/1962 Vordahl et al.
3,106,959 A 10/1963 Huitt et al.
3,142,338 A 7/1964 Brown
3,152,009 A 10/1964 DeLong
3,180,728 A 4/1965 Pryor et al.
3,180,778 A 4/1965 Rinderspacher et al.
3,196,949 A 7/1965 Thomas
3,226,314 A 12/1965 Wellington et al.
3,242,988 A 3/1966 McGuire, Jr. et al.
3,295,935 A 1/1967 Pflumm et al.
3,298,440 A 1/1967 Current
3,316,748 A 5/1967 Lang et al.
3,326,291 A 6/1967 Zandemer
3,347,714 A 10/1967 Broverman et al.
3,385,696 A 5/1968 Hitchcock et al.
3,390,724 A 7/1968 Caldwell
3,395,758 A 8/1968 Kelly et al.
3,406,101 A 10/1968 Kilpatrick
3,416,918 A 12/1968 Roberts
3,434,539 A 3/1969 Merritt
3,445,148 A 5/1969 Harris et al.
3,445,731 A 5/1969 Saeki et al.
3,465,181 A 9/1969 Colby et al.
3,489,218 A 1/1970 Means
3,513,230 A 5/1970 Rhees et al.
3,600,163 A 8/1971 Badia et al.
3,602,305 A 8/1971 Kisling
3,637,446 A 1/1972 Elliott et al.
3,645,331 A 2/1972 Maurer et al.
3,660,049 A 5/1972 Benjamin
3,765,484 A 10/1973 Hamby, Jr. et al.
3,768,563 A 10/1973 Blount
3,775,823 A 12/1973 Adolph et al.
3,816,080 A 6/1974 Bomford et al.
3,823,045 A 7/1974 Hielema
3,878,889 A 4/1975 Seabourne
3,894,850 A 7/1975 Kovalchuk et al.
3,924,677 A 12/1975 Prenner et al.
3,957,483 A 5/1976 Suzuki
4,010,583 A 3/1977 Highberg
4,039,717 A 8/1977 Titus
4,050,529 A 9/1977 Tagirov et al.
4,157,732 A 6/1979 Fonner
4,248,307 A 2/1981 Silberman et al.
4,264,362 A 4/1981 Serveg et al.
4,284,137 A 8/1981 Taylor
4,292,377 A 9/1981 Petersen et al.
4,368,788 A 1/1983 Drake
4,372,384 A 2/1983 Kinney
4,373,584 A 2/1983 Silberman et al.
4,373,952 A 2/1983 Parent
4,374,543 A 2/1983 Richardson
4,384,616 A 5/1983 Dellinger
4,395,440 A 7/1983 Abe et al.
4,399,871 A 8/1983 Adkins et al.
4,407,368 A 10/1983 Erbstoesser
4,422,508 A 12/1983 Rutledge, Jr. et al.
4,450,136 A 5/1984 Dudek et al.
4,452,311 A 6/1984 Speegle et al.
4,475,729 A 10/1984 Costigan
4,498,543 A 2/1985 Pye et al.
4,499,048 A 2/1985 Hanejko
4,499,049 A 2/1985 Hanejko
4,524,825 A 6/1985 Fore
4,526,840 A 7/1985 Jerabek
4,534,414 A 8/1985 Pringle
4,539,175 A 9/1985 Lichti et al.
4,554,986 A 11/1985 Jones
4,619,699 A 10/1986 Petkovic-Luton et al.
4,640,354 A 2/1987 Boisson
4,648,901 A 3/1987 Murray et al.
4,655,852 A 4/1987 Rallis
4,664,962 A 5/1987 DesMarais, Jr.
4,668,470 A 5/1987 Gilman et al.
4,673,549 A 6/1987 Ecer
4,674,572 A 6/1987 Gallus
4,678,037 A 7/1987 Smith
4,681,133 A 7/1987 Weston
4,688,641 A 8/1987 Knieriemen
4,690,796 A 9/1987 Paliwal
4,693,863 A 9/1987 Del Corso et al.
4,703,807 A 11/1987 Weston
4,706,753 A 11/1987 Ohkochi et al.
4,708,202 A 11/1987 Sukup et al.
4,708,208 A 11/1987 Halbardier
4,709,761 A 12/1987 Setterberg, Jr.
4,714,116 A 12/1987 Brunner
4,716,964 A 1/1988 Erbstoesser et al.
4,719,971 A 1/1988 Owens
4,721,159 A 1/1988 Ohkochi et al.
4,738,599 A 4/1988 Shilling
4,741,973 A 5/1988 Condit et al.
4,768,588 A 9/1988 Kupsa
4,775,598 A 10/1988 Jaeckel
4,784,226 A 11/1988 Wyatt
4,805,699 A 2/1989 Halbardier
4,817,725 A 4/1989 Jenkins
4,834,184 A 5/1989 Streich et al.
H635 H 6/1989 Johnson et al.
4,853,056 A 8/1989 Hoffman
4,869,324 A 9/1989 Holder
4,869,325 A 9/1989 Halbardier
4,875,948 A 10/1989 Verneker
4,880,059 A 11/1989 Brandell et al.
4,889,187 A 12/1989 Terrell et al.
4,890,675 A 1/1990 Dew
4,901,794 A 2/1990 Baugh et al.
4,909,320 A 3/1990 Hebert et al.
4,916,029 A 4/1990 Nagle et al.
4,917,966 A 4/1990 Wilde et al.
4,921,664 A 5/1990 Couper
4,929,415 A 5/1990 Okazaki
4,932,474 A 6/1990 Schroeder, Jr. et al.
4,934,459 A 6/1990 Baugh et al.
4,938,309 A 7/1990 Emdy
4,938,809 A 7/1990 Das et al.

(56) References Cited

U.S. PATENT DOCUMENTS

| | | | |
|---|---|---|---|
| 4,944,351 | A | 7/1990 | Eriksen et al. |
| 4,949,788 | A | 8/1990 | Szarka et al. |
| 4,952,902 | A | 8/1990 | Kawaguchi et al. |
| 4,975,412 | A | 12/1990 | Okazaki et al. |
| 4,977,958 | A | 12/1990 | Miller |
| 4,981,177 | A | 1/1991 | Carmody et al. |
| 4,986,361 | A | 1/1991 | Muuller et al. |
| 4,997,622 | A | 3/1991 | Regazzoni et al. |
| 5,006,044 | A | 4/1991 | Walker, Sr. et al. |
| 5,010,955 | A | 4/1991 | Springer |
| 5,036,921 | A | 8/1991 | Pittard et al. |
| 5,048,611 | A | 9/1991 | Cochran |
| 5,049,165 | A | 9/1991 | Tselesin |
| 5,061,323 | A | 10/1991 | DeLuccia |
| 5,063,775 | A | 11/1991 | Walker, Sr. et al. |
| 5,073,207 | A | 12/1991 | Faure et al. |
| 5,074,361 | A | 12/1991 | Brisco et al. |
| 5,076,869 | A | 12/1991 | Bourell et al. |
| 5,084,088 | A | 1/1992 | Okazaki |
| 5,087,304 | A | 2/1992 | Chang et al. |
| 5,090,480 | A | 2/1992 | Pittard et al. |
| 5,095,988 | A | 3/1992 | Bode |
| 5,103,911 | A | 4/1992 | Heijnen |
| 5,106,702 | A | 4/1992 | Walker et al. |
| 5,117,915 | A | 6/1992 | Mueller et al. |
| 5,143,795 | A | 9/1992 | Das et al. |
| 5,161,614 | A | 11/1992 | Wu et al. |
| 5,171,734 | A | 12/1992 | Sanjurjo et al. |
| 5,178,216 | A | 1/1993 | Giroux et al. |
| 5,181,571 | A | 1/1993 | Mueller et al. |
| 5,183,631 | A | 2/1993 | Kugimiya et al. |
| 5,188,182 | A | 2/1993 | Echols, III et al. |
| 5,188,183 | A | 2/1993 | Hopmann et al. |
| 5,204,055 | A | 4/1993 | Sachs et al. |
| 5,222,867 | A | 6/1993 | Walker, Sr. et al. |
| 5,226,483 | A | 7/1993 | Williamson, Jr. |
| 5,228,518 | A | 7/1993 | Wilson et al. |
| 5,234,055 | A | 8/1993 | Cornette |
| 5,238,646 | A | 8/1993 | Tarcy et al. |
| 5,240,495 | A | 8/1993 | Dieckmann et al. |
| 5,240,742 | A | 8/1993 | Johnson et al. |
| 5,252,365 | A | 10/1993 | White |
| 5,253,714 | A | 10/1993 | Davis et al. |
| 5,271,468 | A | 12/1993 | Streich et al. |
| 5,273,569 | A | 12/1993 | Gilman et al. |
| 5,282,509 | A | 2/1994 | Schurr, III |
| 5,285,798 | A | 2/1994 | Banerjee et al. |
| 5,292,478 | A | 3/1994 | Scorey |
| 5,293,940 | A | 3/1994 | Hromas et al. |
| 5,304,260 | A | 4/1994 | Aikawa et al. |
| 5,304,588 | A | 4/1994 | Boysen et al. |
| 5,309,874 | A | 5/1994 | Willermet et al. |
| 5,310,000 | A | 5/1994 | Arterbury et al. |
| 5,316,598 | A | 5/1994 | Chang et al. |
| 5,318,746 | A | 6/1994 | Lashmore et al. |
| 5,336,466 | A | 8/1994 | Iba |
| 5,342,576 | A | 8/1994 | Whitehead |
| 5,352,522 | A | 10/1994 | Kugimiya et al. |
| 5,380,473 | A | 1/1995 | Bogue et al. |
| 5,387,380 | A | 2/1995 | Cima et al. |
| 5,392,860 | A | 2/1995 | Ross |
| 5,394,236 | A | 2/1995 | Murnick |
| 5,394,941 | A | 3/1995 | Venditto et al. |
| 5,398,754 | A | 3/1995 | Dinhoble |
| 5,407,011 | A | 4/1995 | Layton |
| 5,409,555 | A | 4/1995 | Fujita et al. |
| 5,411,082 | A | 5/1995 | Kennedy |
| 5,417,285 | A | 5/1995 | Van Buskirk et al. |
| 5,425,424 | A | 6/1995 | Reinhardt et al. |
| 5,427,177 | A | 6/1995 | Jordan, Jr. et al. |
| 5,435,392 | A | 7/1995 | Kennedy |
| 5,439,051 | A | 8/1995 | Kennedy et al. |
| 5,454,430 | A | 10/1995 | Kennedy et al. |
| 5,456,317 | A | 10/1995 | Hood, III et al. |
| 5,456,327 | A | 10/1995 | Denton et al. |
| 5,464,062 | A | 11/1995 | Blizzard, Jr. |
| 5,472,048 | A | 12/1995 | Kennedy |
| 5,474,131 | A | 12/1995 | Jordan, Jr. et al. |
| 5,476,632 | A | 12/1995 | Shivanath et al. |
| 5,477,923 | A | 12/1995 | Jordan, Jr. et al. |
| 5,479,986 | A | 1/1996 | Gano et al. |
| 5,494,538 | A | 2/1996 | Kirillov et al. |
| 5,506,055 | A | 4/1996 | Dorfman et al. |
| 5,507,439 | A | 4/1996 | Story |
| 5,511,620 | A | 4/1996 | Baugh et al. |
| 5,524,699 | A | 6/1996 | Cook |
| 5,526,880 | A | 6/1996 | Jordan, Jr. et al. |
| 5,526,881 | A | 6/1996 | Martin et al. |
| 5,529,746 | A | 6/1996 | Knoss et al. |
| 5,531,735 | A | 7/1996 | Thompson |
| 5,533,573 | A | 7/1996 | Jordan, Jr. et al. |
| 5,536,485 | A | 7/1996 | Kume et al. |
| 5,552,110 | A | 9/1996 | Iba |
| 5,558,153 | A | 9/1996 | Holcombe et al. |
| 5,601,924 | A | 2/1997 | Beane et al. |
| 5,607,017 | A | 3/1997 | Owens et al. |
| 5,623,993 | A | 4/1997 | Van Buskirk et al. |
| 5,623,994 | A | 4/1997 | Robinson |
| 5,641,023 | A | 6/1997 | Ross et al. |
| 5,636,691 | A | 7/1997 | Hendrickson et al. |
| 5,647,444 | A | 7/1997 | Williams |
| 5,665,289 | A | 9/1997 | Chung et al. |
| 5,677,372 | A | 10/1997 | Yamamoto et al. |
| 5,685,372 | A | 11/1997 | Gano |
| 5,701,576 | A | 12/1997 | Fujita et al. |
| 5,707,214 | A | 1/1998 | Schmidt |
| 5,709,269 | A | 1/1998 | Head |
| 5,720,344 | A | 2/1998 | Newman |
| 5,722,033 | A | 2/1998 | Carden |
| 5,728,195 | A | 3/1998 | Eastman et al. |
| 5,765,639 | A | 6/1998 | Muth |
| 5,767,562 | A | 6/1998 | Yamashita |
| 5,772,735 | A | 6/1998 | Sehgal et al. |
| 5,782,305 | A | 7/1998 | Hicks |
| 5,797,454 | A | 8/1998 | Hipp |
| 5,820,608 | A | 10/1998 | Luzio et al. |
| 5,826,652 | A | 10/1998 | Tapp |
| 5,826,661 | A | 10/1998 | Parker et al. |
| 5,829,520 | A | 11/1998 | Johnson |
| 5,836,396 | A | 11/1998 | Norman |
| 5,857,521 | A | 1/1999 | Ross et al. |
| 5,881,816 | A | 3/1999 | Wright |
| 5,896,819 | A | 4/1999 | Turila et al. |
| 5,902,424 | A | 5/1999 | Fujita et al. |
| 5,934,372 | A | 8/1999 | Muth |
| 5,941,309 | A | 8/1999 | Appleton |
| 5,960,881 | A | 10/1999 | Allamon et al. |
| 5,964,965 | A | 10/1999 | Schulz et al. |
| 5,894,007 | A | 11/1999 | Yuan et al. |
| 5,980,602 | A | 11/1999 | Carden |
| 5,985,466 | A | 11/1999 | Atarashi et al. |
| 5,988,287 | A | 11/1999 | Jordan, Jr. et al. |
| 5,990,051 | A | 11/1999 | Ischy et al. |
| 5,992,452 | A | 11/1999 | Nelson, II |
| 5,992,520 | A | 11/1999 | Schultz et al. |
| 6,007,314 | A | 12/1999 | Nelson, II |
| 6,024,915 | A | 2/2000 | Kume et al. |
| 6,030,637 | A | 2/2000 | Whitehead |
| 6,032,735 | A | 3/2000 | Echols |
| 6,033,622 | A | 3/2000 | Maruyama |
| 6,036,777 | A | 3/2000 | Sachs |
| 6,036,792 | A | 3/2000 | Chu et al. |
| 6,040,087 | A | 3/2000 | Kawakami |
| 6,047,773 | A | 4/2000 | Zeltmann et al. |
| 6,050,340 | A | 4/2000 | Scott |
| 6,069,313 | A | 5/2000 | Kay |
| 6,076,600 | A | 6/2000 | Vick, Jr. et al. |
| 6,079,496 | A | 6/2000 | Hirth |
| 6,085,837 | A | 7/2000 | Massinon et al. |
| 6,095,247 | A | 8/2000 | Streich et al. |
| 6,119,783 | A | 9/2000 | Parker et al. |
| 6,126,898 | A | 10/2000 | Butler |
| 6,142,237 | A | 11/2000 | Christmas et al. |
| 6,161,622 | A | 12/2000 | Robb et al. |

(56) References Cited

U.S. PATENT DOCUMENTS 6,167,970 B1 1/2001 Stout et al.
6,170,583 B1 1/2001 Boyce
6,171,359 B1 1/2001 Levinski et al.
6,173,779 B1 1/2001 Smith
6,176,323 B1 1/2001 Weirich et al.
6,189,616 B1 2/2001 Gano et al.
6,189,618 B1 2/2001 Beeman et al.
6,213,202 B1 4/2001 Read, Jr.
6,220,349 B1 4/2001 Vargus et al.
6,220,350 B1 4/2001 Brothers et al.
6,220,357 B1 4/2001 Carmichael et al.
6,228,904 B1 5/2001 Yadav et al.
6,230,799 B1 5/2001 Slaughter et al.
6,237,688 B1 5/2001 Burleson et al.
6,238,280 B1 5/2001 Ritt et al.
6,241,021 B1 6/2001 Bowling
6,248,399 B1 6/2001 Hehmann
6,250,392 B1 6/2001 Muth
6,261,432 B1 7/2001 Huber et al.
6,265,205 B1 7/2001 Hitchens et al.
6,273,187 B1 8/2001 Voisin, Jr. et al.
6,276,452 B1 8/2001 Davis et al.
6,276,457 B1 8/2001 Moffatt et al.
6,279,656 B1 8/2001 Sinclair et al.
6,287,332 B1 9/2001 Bolz et al.
6,287,445 B1 9/2001 Lashmore et al.
6,302,205 B1 10/2001 Ryll
6,315,041 B1 11/2001 Carlisle et al.
6,315,050 B2 11/2001 Vaylnshteyn et al.
6,325,148 B1 12/2001 Trahan et al.
6,328,110 B1 12/2001 Joubert
6,341,653 B1 1/2002 Fermaniuk et al.
6,341,747 B1 1/2002 Schmidt et al.
6,349,766 B1 2/2002 Bussear et al.
6,354,372 B1 3/2002 Carisell et al.
6,354,379 B2 3/2002 Miszewski et al.
6,371,206 B1 4/2002 Mills
6,372,346 B1 4/2002 Toth
6,382,244 B2 5/2002 Vann
6,390,195 B1 5/2002 Nguyen et al.
6,390,200 B1 5/2002 Allamon et al.
6,394,180 B1 5/2002 Berscheidt et al.
6,394,185 B1 5/2002 Constien
6,395,402 B1 5/2002 Lambert et al.
6,397,950 B1 6/2002 Streich et al.
6,401,547 B1 6/2002 Hatfield et al.
6,403,210 B1 6/2002 Stuivinga et al.
6,408,946 B1 6/2002 Marshall et al.
6,419,023 B1 7/2002 George et al.
6,422,314 B1 7/2002 Todd et al.
6,439,313 B1 8/2002 Thomeer et al.
6,444,316 B1 9/2002 Reddy et al.
6,446,717 B1 9/2002 White et al.
6,457,525 B1 10/2002 Scott
6,467,546 B2 10/2002 Allamon et al.
6,470,965 B1 10/2002 Winzer
6,491,097 B1 12/2002 Oneal et al.
6,491,116 B2 12/2002 Berscheidt et al.
6,513,598 B2 2/2003 Moore et al.
6,513,600 B2 2/2003 Ross
6,527,051 B1 3/2003 Reddy et al.
6,540,033 B1 4/2003 Sullivan et al.
6,543,543 B2 4/2003 Muth
6,554,071 B1 4/2003 Reddy et al.
6,561,275 B2 5/2003 Glass et al.
6,581,681 B1 6/2003 Zimmerman et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,609,569 B2 8/2003 Howlett et al.
6,612,826 B1 9/2003 Bauer et al.
6,613,383 B1 9/2003 George et al.
6,619,400 B2 9/2003 Brunet
6,630,008 B1 10/2003 Meeks, III et al.
6,634,428 B2 10/2003 Krauss et al.
6,662,886 B2 12/2003 Russell
6,675,889 B1 1/2004 Mullins et al.
6,699,305 B2 3/2004 Myrick
6,712,153 B2 3/2004 Turley et al.
6,712,797 B1 3/2004 Southern, Jr.
6,713,177 B2 3/2004 George et al.
6,715,541 B2 4/2004 Pedersen et al.
6,737,385 B2 5/2004 Todd et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,887,297 B2 5/2005 Winter et al.
6,896,049 B2 5/2005 Moyes
6,896,061 B2 5/2005 Hriscu et al.
6,899,777 B2 5/2005 Vaidyanathan et al.
6,908,516 B2 6/2005 Hehmann et al.
6,913,827 B2 7/2005 Georget et al.
6,926,086 B2 8/2005 Patterson et al.
6,932,159 B2 8/2005 Hovem
6,939,388 B2 9/2005 Angeliu
6,945,331 B2 9/2005 Patel
6,951,331 B2 10/2005 Haughom et al.
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,013,998 B2 3/2006 Ray et al.
7,017,664 B2 3/2006 Walker et al.
7,017,677 B2 3/2006 Keshavan et al.
7,021,389 B2 4/2006 Bishop et al.
7,025,146 B2 4/2006 King et al.
7,028,778 B2 4/2006 Krywitsky
7,044,230 B2 5/2006 Starr et al.
7,048,812 B2 5/2006 Bettles et al.
7,049,272 B2 5/2006 Sinclair et al.
7,051,805 B2 5/2006 Doane et al.
7,059,410 B2 6/2006 Bousche et al.
7,063,748 B2 6/2006 Talton
7,090,027 B1 8/2006 Williams
7,093,664 B2 8/2006 Todd et al.
7,096,945 B2 8/2006 Richards et al.
7,096,946 B2 8/2006 Jasser et al.
7,097,807 B1 8/2006 Meeks, III et al.
7,097,906 B2 8/2006 Gardner
7,108,080 B2 9/2006 Tessari et al.
7,111,682 B2 9/2006 Blaisdell
7,128,145 B2 10/2006 Mickey
7,141,207 B2 11/2006 Jandeska, Jr. et al.
7,150,326 B2 12/2006 Bishop et al.
7,163,066 B2 1/2007 Lehr
7,165,622 B2 1/2007 Hirth et al.
7,168,494 B2 1/2007 Starr et al.
7,174,963 B2 2/2007 Bertelsen
7,182,135 B2 2/2007 Szarka
7,188,559 B1 3/2007 Vecchio
7,210,527 B2 5/2007 Walker et al.
7,210,533 B2 5/2007 Starr et al.
7,217,311 B2 5/2007 Hong et al.
7,234,530 B2 6/2007 Gass
7,250,188 B2 7/2007 Dodelet et al.
7,252,162 B2 8/2007 Akinlade et al.
7,255,172 B2 8/2007 Johnson
7,255,178 B2 8/2007 Slup et al.
7,264,060 B2 9/2007 Wills
7,267,172 B2 9/2007 Hofman
7,267,178 B2 9/2007 Krywitsky
7,270,186 B2 9/2007 Johnson
7,287,592 B2 10/2007 Surjaatmadja et al.
7,311,152 B2 12/2007 Howard et al.
7,316,274 B2 1/2008 Xu et al.
7,320,365 B2 1/2008 Pia
7,322,412 B2 1/2008 Badalamenti et al.
7,322,417 B2 1/2008 Rytlewski et al.

(56) References Cited

U.S. PATENT DOCUMENTS

| | | | |
|---|---|---|---|
| 7,325,617 | B2 | 2/2008 | Murray |
| 7,328,750 | B2 | 2/2008 | Swor et al. |
| 7,331,388 | B2 | 2/2008 | Vilela et al. |
| 7,337,854 | B2 | 3/2008 | Horn et al. |
| 7,346,456 | B2 | 3/2008 | Le Bemadjiel |
| 7,350,582 | B2 | 4/2008 | McKeachnie et al. |
| 7,353,867 | B2 | 4/2008 | Carter et al. |
| 7,353,879 | B2 | 4/2008 | Todd et al. |
| 7,360,593 | B2 | 4/2008 | Constien |
| 7,360,597 | B2 | 4/2008 | Blaisdell |
| 7,363,970 | B2 | 4/2008 | Corre et al. |
| 7,373,978 | B2 | 5/2008 | Barry et al. |
| 7,380,600 | B2 | 6/2008 | Willberg et al. |
| 7,384,443 | B2 | 6/2008 | Mirchandani |
| 7,387,158 | B2 | 6/2008 | Murray et al. |
| 7,387,165 | B2 | 6/2008 | Lopez de Cardenas et al. |
| 7,392,841 | B2 | 7/2008 | Murray et al. |
| 7,401,648 | B2 | 7/2008 | Richard |
| 7,416,029 | B2 | 8/2008 | Telfer et al. |
| 7,422,058 | B2 | 9/2008 | O'Malley |
| 7,426,964 | B2 | 9/2008 | Lynde et al. |
| 7,441,596 | B2 | 10/2008 | Wood et al. |
| 7,445,049 | B2 | 11/2008 | Howard et al. |
| 7,451,815 | B2 | 11/2008 | Hailey, Jr. |
| 7,451,817 | B2 | 11/2008 | Reddy et al. |
| 7,461,699 | B2 | 12/2008 | Richard et al. |
| 7,464,752 | B2 | 12/2008 | Dale et al. |
| 7,464,764 | B2 | 12/2008 | Xu |
| 7,472,750 | B2 | 1/2009 | Walker et al. |
| 7,478,676 | B2 | 1/2009 | East, Jr. et al. |
| 7,491,444 | B2 | 2/2009 | Smith et al. |
| 7,503,390 | B2 | 3/2009 | Gomez |
| 7,503,392 | B2 | 3/2009 | King et al. |
| 7,503,399 | B2 | 3/2009 | Badalamenti et al. |
| 7,509,993 | B1 | 3/2009 | Turng et al. |
| 7,510,018 | B2 | 3/2009 | Williamson et al. |
| 7,513,311 | B2 | 4/2009 | Gramstad et al. |
| 7,516,791 | B2 | 4/2009 | Bryant et al. |
| 7,520,944 | B2 | 4/2009 | Johnson |
| 7,527,103 | B2 | 5/2009 | Huang et al. |
| 7,531,020 | B2 | 5/2009 | Woodfield et al. |
| 7,531,021 | B2 | 5/2009 | Woodfield et al. |
| 7,537,825 | B1 | 5/2009 | Wardle et al. |
| 7,552,777 | B2 | 6/2009 | Murray et al. |
| 7,552,779 | B2 | 6/2009 | Murray |
| 7,559,357 | B2 | 7/2009 | Clem |
| 7,575,062 | B2 | 8/2009 | East, Jr. |
| 7,579,087 | B2 | 8/2009 | Maloney et al. |
| 7,591,318 | B2 | 9/2009 | Tilghman |
| 7,600,572 | B2 | 10/2009 | Slup et al. |
| 7,604,049 | B2 | 10/2009 | Vaidya et al. |
| 7,604,055 | B2 | 10/2009 | Richard et al. |
| 7,607,476 | B2 | 10/2009 | Tom et al. |
| 7,617,871 | B2 | 11/2009 | Surjaatmadja et al. |
| 7,635,023 | B2 | 12/2009 | Goldberg et al. |
| 7,640,988 | B2 | 1/2010 | Phi et al. |
| 7,647,964 | B2 | 1/2010 | Akbar et al. |
| 7,661,480 | B2 | 2/2010 | Al-Anazi |
| 7,661,481 | B2 | 2/2010 | Todd et al. |
| 7,665,537 | B2 | 2/2010 | Patel et al. |
| 7,686,082 | B2 | 3/2010 | Marsh |
| 7,690,436 | B2 | 4/2010 | Turley et al. |
| 7,699,101 | B2 | 4/2010 | Fripp et al. |
| 7,700,038 | B2 | 4/2010 | Soran et al. |
| 7,703,511 | B2 | 4/2010 | Buyers et al. |
| 7,708,078 | B2 | 5/2010 | Stoesz |
| 7,709,421 | B2 | 5/2010 | Jones et al. |
| 7,712,541 | B2 | 5/2010 | Loretz et al. |
| 7,723,272 | B2 | 5/2010 | Crews et al. |
| 7,726,406 | B2 | 6/2010 | Xu |
| 7,735,578 | B2 | 6/2010 | Loehr et al. |
| 7,743,836 | B2 | 6/2010 | Cook et al. |
| 7,752,971 | B2 | 7/2010 | Loehr |
| 7,757,773 | B2 | 7/2010 | Rytlewski |
| 7,762,342 | B2 | 7/2010 | Richard et al. |
| 7,770,652 | B2 | 8/2010 | Barnett |
| 7,771,289 | B2 | 8/2010 | Palumbo et al. |
| 7,771,547 | B2 | 8/2010 | Bieler et al. |
| 7,775,284 | B2 | 8/2010 | Richard et al. |
| 7,775,285 | B2 | 8/2010 | Surjaatmadja et al. |
| 7,775,286 | B2 | 8/2010 | Duphorne |
| 7,784,543 | B2 | 8/2010 | Johnson |
| 7,793,714 | B2 | 9/2010 | Johnson |
| 7,793,820 | B2 | 9/2010 | Hirano et al. |
| 7,794,520 | B2 | 9/2010 | Murty et al. |
| 7,798,225 | B2 | 9/2010 | Giroux et al. |
| 7,798,226 | B2 | 9/2010 | Themig |
| 7,798,236 | B2 | 9/2010 | McKeachnie et al. |
| 7,806,189 | B2 | 10/2010 | Frazier |
| 7,806,192 | B2 | 10/2010 | Foster et al. |
| 7,810,553 | B2 | 10/2010 | Cruickshank et al. |
| 7,810,567 | B2 | 10/2010 | Daniels et al. |
| 7,819,198 | B2 | 10/2010 | Birckhead et al. |
| 7,828,055 | B2 | 11/2010 | Willauer et al. |
| 7,833,944 | B2 | 11/2010 | Munoz et al. |
| 7,849,927 | B2 | 12/2010 | Herrera |
| 7,851,016 | B2 | 12/2010 | Arbab et al. |
| 7,855,168 | B2 | 12/2010 | Fuller et al. |
| 7,861,779 | B2 | 1/2011 | Vestavik |
| 7,861,781 | B2 | 1/2011 | D'Arcy |
| 7,874,365 | B2 | 1/2011 | East, Jr. et al. |
| 7,878,253 | B2 | 2/2011 | Stowe et al. |
| 7,879,162 | B2 | 2/2011 | Pandey |
| 7,879,367 | B2 | 2/2011 | Heublein et al. |
| 7,896,091 | B2 | 3/2011 | Williamson et al. |
| 7,897,063 | B1 | 3/2011 | Perry et al. |
| 7,900,696 | B1 | 3/2011 | Nish et al. |
| 7,900,703 | B2 | 3/2011 | Clark et al. |
| 7,909,096 | B2 | 3/2011 | Clark et al. |
| 7,909,104 | B2 | 3/2011 | Bjorgum |
| 7,909,110 | B2 | 3/2011 | Sharma et al. |
| 7,909,115 | B2 | 3/2011 | Grove et al. |
| 7,913,765 | B2 | 3/2011 | Crow et al. |
| 7,918,275 | B2 | 4/2011 | Clem |
| 7,931,093 | B2 | 4/2011 | Foster et al. |
| 7,938,191 | B2 | 5/2011 | Vaidya |
| 7,946,335 | B2 | 5/2011 | Bewlay et al. |
| 7,946,340 | B2 | 5/2011 | Surjattmadja et al. |
| 7,958,940 | B2 | 6/2011 | Jameson |
| 7,963,331 | B2 | 6/2011 | Surjattmadja et al. |
| 7,963,340 | B2 | 6/2011 | Gramstad et al. |
| 7,963,342 | B2 | 6/2011 | George |
| 7,980,300 | B2 | 7/2011 | Roberts et al. |
| 7,987,906 | B1 | 8/2011 | Troy |
| 7,992,763 | B2 | 8/2011 | Vecchio et al. |
| 7,999,987 | B2 | 8/2011 | Dellinger et al. |
| 8,002,821 | B2 | 8/2011 | Stinson |
| 8,020,619 | B1 | 9/2011 | Robertson et al. |
| 8,020,620 | B2 | 9/2011 | Daniels et al. |
| 8,025,104 | B2 | 9/2011 | Cooke, Jr. |
| 8,028,767 | B2 | 10/2011 | Radford et al. |
| 8,033,331 | B2 | 10/2011 | Themig |
| 8,034,152 | B2 | 10/2011 | Westin et al. |
| 8,039,422 | B1 | 10/2011 | Al-Zahrani |
| 8,056,628 | B2 | 11/2011 | Whitsitt et al. |
| 8,056,638 | B2 | 11/2011 | Clayton et al. |
| 8,109,340 | B2 | 2/2012 | Doane et al. |
| 8,114,148 | B2 | 2/2012 | Atanasoska et al. |
| 8,119,713 | B2 | 2/2012 | Dubois et al. |
| 8,127,856 | B1 | 3/2012 | Nish et al. |
| 8,153,052 | B2 | 4/2012 | Jackson et al. |
| 8,163,060 | B2 | 4/2012 | Imanishi et al. |
| 8,167,043 | B2 | 5/2012 | Willberg et al. |
| 8,211,247 | B2 | 7/2012 | Marya et al. |
| 8,211,248 | B2 | 7/2012 | Marya |
| 8,211,331 | B2 | 7/2012 | Jorgensen et al. |
| 8,220,554 | B2 | 7/2012 | Jordan et al. |
| 8,226,740 | B2 | 7/2012 | Chaumonnot et al. |
| 8,230,731 | B2 | 7/2012 | Dyer et al. |
| 8,231,947 | B2 | 7/2012 | Vaidya et al. |
| 8,263,178 | B2 | 9/2012 | Boulos et al. |
| 8,267,177 | B1 | 9/2012 | Vogel et al. |
| 8,276,670 | B2 | 10/2012 | Patel |
| 8,277,974 | B2 | 10/2012 | Kumar et al. |

(56) References Cited

U.S. PATENT DOCUMENTS

| | | | |
|---|---|---|---|
| 8,297,364 | B2 | 10/2012 | Agrawal et al. |
| 8,327,931 | B2 | 12/2012 | Agrawal et al. |
| 8,403,037 | B2 | 3/2013 | Agrawal et al. |
| 8,413,727 | B2 | 4/2013 | Holmes |
| 8,425,651 | B2 | 4/2013 | Xu et al. |
| 8,459,347 | B2 | 6/2013 | Stout |
| RE44,385 | E | 7/2013 | Johnson |
| 8,485,265 | B2 | 7/2013 | Marya et al. |
| 8,486,329 | B2 | 7/2013 | Shikai et al. |
| 8,490,674 | B2 | 7/2013 | Stevens et al. |
| 8,490,689 | B1 | 7/2013 | McClinton et al. |
| 8,506,733 | B2 | 8/2013 | Enami et al. |
| 8,528,633 | B2 | 9/2013 | Agrawal et al. |
| 8,535,604 | B1 | 9/2013 | Baker et al. |
| 8,573,295 | B2 | 11/2013 | Johnson et al. |
| 8,579,023 | B1 | 11/2013 | Nish et al. |
| 8,613,789 | B2 | 12/2013 | Han et al. |
| 8,631,876 | B2 | 1/2014 | Xu et al. |
| 8,663,401 | B2 | 3/2014 | Marya et al. |
| 8,668,762 | B2 | 3/2014 | Kim et al. |
| 8,695,684 | B2 | 4/2014 | Chen et al. |
| 8,695,714 | B2 | 4/2014 | Xu |
| 8,714,268 | B2 | 5/2014 | Agrawal et al. |
| 8,715,339 | B2 | 5/2014 | Atanasoska et al. |
| 8,723,564 | B2 | 5/2014 | Kim et al. |
| 8,734,564 | B2 | 5/2014 | Kim et al. |
| 8,734,602 | B2 | 5/2014 | Li et al. |
| 8,746,342 | B1 | 6/2014 | Nish et al. |
| 8,770,261 | B2 | 7/2014 | Marya |
| 8,776,884 | B2 | 7/2014 | Xu |
| 8,789,610 | B2 | 7/2014 | Oxford |
| 8,808,423 | B2 | 8/2014 | Kim et al. |
| 8,852,363 | B2 | 10/2014 | Numano et al. |
| 8,905,147 | B2 | 12/2014 | Fripp et al. |
| 8,950,504 | B2 | 2/2015 | Xu et al. |
| 8,956,660 | B2 | 2/2015 | Launag et al. |
| 8,967,275 | B2 | 3/2015 | Crews |
| 8,978,734 | B2 | 3/2015 | Stevens |
| 8,991,485 | B2 | 3/2015 | Chenault et al. |
| 8,998,978 | B2 | 4/2015 | Wang |
| 9,010,416 | B2 | 4/2015 | Xu et al. |
| 9,010,424 | B2 | 4/2015 | Agrawal et al. |
| 9,016,363 | B2 | 4/2015 | Xu |
| 9,016,384 | B2 | 4/2015 | Xu |
| 9,022,107 | B2 | 5/2015 | Agrawal et al. |
| 9,027,655 | B2 | 5/2015 | Xu |
| 9,033,041 | B2 | 5/2015 | Baihly et al. |
| 9,033,060 | B2 | 5/2015 | Xu et al. |
| 9,044,397 | B2 | 6/2015 | Choi et al. |
| 9,057,117 | B2 | 6/2015 | Harrison et al. |
| 9,057,242 | B2 | 6/2015 | Mazyar et al. |
| 9,068,428 | B2 | 6/2015 | Mazyar et al. |
| 9,079,246 | B2 | 7/2015 | Xu et al. |
| 9,080,098 | B2 | 7/2015 | Xu et al. |
| 9,080,403 | B2 | 7/2015 | Xu et al. |
| 9,080,439 | B2 | 7/2015 | O'Malley |
| 9,089,408 | B2 | 7/2015 | Xu |
| 9,090,955 | B2 | 7/2015 | Xu et al. |
| 9,090,956 | B2 | 7/2015 | Xu |
| 9,101,978 | B2 | 8/2015 | Xu |
| 9,109,429 | B2 | 8/2015 | Xu et al. |
| 9,119,906 | B2 | 9/2015 | Tomantschager et al. |
| 9,127,515 | B2 | 9/2015 | Xu et al. |
| 9,163,467 | B2 | 10/2015 | Gaudette et al. |
| 9,181,088 | B2 | 11/2015 | Sibuet et al. |
| 9,187,686 | B2 | 11/2015 | Crews |
| 9,211,586 | B1 | 12/2015 | Lavernia et al. |
| 9,217,319 | B2 | 12/2015 | Frazier et al. |
| 9,227,243 | B2 | 1/2016 | Xu et al. |
| 9,243,475 | B2 | 1/2016 | Xu |
| 9,260,935 | B2 | 2/2016 | Murphree et al. |
| 9,284,803 | B2 | 3/2016 | Stone et al. |
| 9,309,733 | B2 | 4/2016 | Xu et al. |
| 9,309,744 | B2 | 4/2016 | Frazier |
| 9,366,106 | B2 | 6/2016 | Xu et al. |
| 9,447,482 | B2 | 9/2016 | Kim et al. |
| 9,458,692 | B2 | 10/2016 | Fripp et al. |
| 9,500,061 | B2 | 11/2016 | Frazier et al. |
| 9,528,343 | B2 | 12/2016 | Jordan et al. |
| 9,587,156 | B2 | 3/2017 | Crews |
| 9,605,508 | B2 | 3/2017 | Xu |
| 9,643,250 | B2 | 5/2017 | Mazyar et al. |
| 9,682,425 | B2 | 6/2017 | Xu et al. |
| 9,689,227 | B2 | 6/2017 | Fripp et al. |
| 9,689,231 | B2 | 6/2017 | Fripp et al. |
| 9,789,663 | B2 | 10/2017 | Zhang et al. |
| 9,790,763 | B2 | 10/2017 | Fripp et al. |
| 9,802,250 | B2 | 10/2017 | Xu |
| 9,803,439 | B2 | 10/2017 | Xu et al. |
| 9,833,838 | B2 | 12/2017 | Mazyar et al. |
| 9,835,016 | B2 | 12/2017 | Zhang et al. |
| 9,863,201 | B2 | 1/2018 | Fripp et al. |
| 9,925,589 | B2 | 3/2018 | Xu |
| 9,926,763 | B2 | 3/2018 | Mazyar et al. |
| 9,938,451 | B2 | 4/2018 | Crews |
| 9,970,249 | B2 | 5/2018 | Zhang et al. |
| 10,016,810 | B2 | 7/2018 | Salinas et al. |
| 10,059,092 | B2 | 8/2018 | Welch et al. |
| 10,059,867 | B2 | 8/2018 | Crews |
| 10,081,853 | B2 | 9/2018 | Wilks et al. |
| 10,082,008 | B2 | 9/2018 | Robey et al. |
| 10,092,953 | B2 | 10/2018 | Mazyar et al. |
| 10,119,358 | B2 | 11/2018 | Walton et al. |
| 10,119,359 | B2 | 11/2018 | Frazier |
| 10,125,565 | B2 | 11/2018 | Fripp et al. |
| 10,167,691 | B2 | 1/2019 | Zhang et al. |
| 10,174,578 | B2 | 1/2019 | Walton et al. |
| 10,202,820 | B2 | 2/2019 | Xu et al. |
| 10,221,637 | B2 | 3/2019 | Xu et al. |
| 10,221,641 | B2 | 3/2019 | Zhang et al. |
| 10,221,642 | B2 | 3/2019 | Zhang et al. |
| 10,221,643 | B2 | 3/2019 | Zhang et al. |
| 10,227,841 | B2 | 3/2019 | Fripp et al. |
| 10,253,590 | B2 | 4/2019 | Xu et al. |
| 10,266,923 | B2 | 4/2019 | Wilks et al. |
| 10,316,601 | B2 | 6/2019 | Walton et al. |
| 10,329,643 | B2 | 6/2019 | Wilks et al. |
| 10,335,855 | B2 | 7/2019 | Welch et al. |
| 10,337,086 | B2 | 7/2019 | Wilks et al. |
| 10,344,568 | B2 | 7/2019 | Murphree et al. |
| 10,364,630 | B2 | 7/2019 | Xu et al. |
| 10,364,631 | B2 | 7/2019 | Xu et al. |
| 10,364,632 | B2 | 7/2019 | Xu et al. |
| 10,450,840 | B2 | 10/2019 | Xu |
| 10,472,909 | B2 | 11/2019 | Xu et al. |
| 10,533,392 | B2 | 1/2020 | Walton et al. |
| 10,544,652 | B2 | 1/2020 | Fripp et al. |
| 10,597,965 | B2 | 3/2020 | Allen |
| 10,612,659 | B2 | 4/2020 | Xu et al. |
| 10,619,438 | B2 | 4/2020 | Fripp et al. |
| 10,619,445 | B2 | 4/2020 | Murphree et al. |
| 10,626,695 | B2 | 4/2020 | Fripp et al. |
| 10,633,947 | B2 | 4/2020 | Fripp et al. |
| 10,655,411 | B2 | 5/2020 | Fripp et al. |
| 10,669,797 | B2 | 6/2020 | Johnson et al. |
| 10,724,321 | B2 | 7/2020 | Leonard et al. |
| 10,737,321 | B2 | 8/2020 | Xu |
| 10,781,658 | B1 | 9/2020 | Kumar et al. |
| 10,807,355 | B2 | 10/2020 | Welch et al. |
| 2002/0020527 | A1 | 2/2002 | Kilaas et al. |
| 2002/0047058 | A1 | 4/2002 | Verhoff et al. |
| 2002/0092654 | A1 | 7/2002 | Coronado et al. |
| 2002/0104616 | A1 | 8/2002 | De et al. |
| 2002/0108756 | A1 | 8/2002 | Harrall et al. |
| 2002/0121081 | A1 | 9/2002 | Cesaroni et al. |
| 2002/0139541 | A1 | 10/2002 | Sheffield et al. |
| 2002/0197181 | A1 | 12/2002 | Osawa et al. |
| 2003/0019639 | A1 | 1/2003 | Mackay |
| 2003/0060374 | A1 | 3/2003 | Cooke, Jr. |
| 2003/0104147 | A1 | 6/2003 | Bretschneider et al. |
| 2003/0111728 | A1 | 6/2003 | Thai et al. |
| 2003/0127013 | A1 | 7/2003 | Zavitsanos et al. |
| 2003/0141060 | A1 | 7/2003 | Hailey, Jr. et al. |
| 2003/0150614 | A1 | 8/2003 | Brown et al. |

(56) References Cited

U.S. PATENT DOCUMENTS

2003/0155114 A1 8/2003 Pedersen et al.
2003/0173005 A1 9/2003 Higashi
2004/0005483 A1 1/2004 Lin
2004/0055758 A1 3/2004 Brezinski et al.
2004/0069502 A1 4/2004 Luke
2004/0089449 A1 5/2004 Walton et al.
2004/0094297 A1 5/2004 Malone et al.
2004/0154806 A1 8/2004 Bode et al.
2004/0159446 A1 8/2004 Haugen et al.
2004/0216868 A1 11/2004 Owens, Sr.
2004/0231845 A1 11/2004 Cooke, Jr.
2004/0244968 A1 12/2004 Cook et al.
2004/0256109 A1 12/2004 Johnson
2004/0261993 A1 12/2004 Nguyen
2004/0261994 A1 12/2004 Nguyen et al.
2005/0064247 A1 3/2005 Sane et al.
2005/0074612 A1 4/2005 Eklund et al.
2005/0098313 A1 5/2005 Atkins et al.
2005/0102255 A1 5/2005 Bultman
2005/0106316 A1 5/2005 Rigney et al.
2005/0161212 A1 7/2005 Leismer et al.
2005/0165149 A1 7/2005 Chanak et al.
2005/0194141 A1 9/2005 Sinclair et al.
2005/0235757 A1 10/2005 De Jonge et al.
2005/0241824 A1 11/2005 Burris, II et al.
2005/0241825 A1 11/2005 Burris, II et al.
2005/0268746 A1 12/2005 Abkowitz et al.
2005/0269097 A1 12/2005 Towler
2005/0275143 A1 12/2005 Toth
2005/0279427 A1 12/2005 Park et al.
2005/0279501 A1 12/2005 Surjaatmadja et al.
2006/0012087 A1 1/2006 Matsuda et al.
2006/0013350 A1 1/2006 Akers
2006/0057479 A1 3/2006 Niimi et al.
2006/0102871 A1 5/2006 Wang et al.
2006/0108114 A1 5/2006 Johnson
2006/0110615 A1 5/2006 Karim et al.
2006/0113077 A1 6/2006 Willberg et al.
2006/0116696 A1 6/2006 Odermatt et al.
2006/0131031 A1 6/2006 McKeachnie
2006/0131081 A1 6/2006 Mirchandani et al.
2006/0144515 A1 7/2006 Tada et al.
2006/0150770 A1 7/2006 Freim, III et al.
2006/0153728 A1 7/2006 Schoenung et al.
2006/0169453 A1 8/2006 Savery et al.
2006/0175059 A1 8/2006 Sinclair et al.
2006/0186602 A1 8/2006 Martin et al.
2006/0207387 A1 9/2006 Soran et al.
2006/0269437 A1 11/2006 Pandey
2006/0278405 A1 12/2006 Turley
2006/0283592 A1 12/2006 Sierra et al.
2007/0017675 A1 1/2007 Hammami et al.
2007/0134496 A1 1/2007 Katagiri et al.
2007/0039161 A1 2/2007 Garcia
2007/0044958 A1 3/2007 Rytlewski et al.
2007/0044966 A1 3/2007 Davies et al.
2007/0051521 A1 3/2007 Fike et al.
2007/0053785 A1 3/2007 Uetz et al.
2007/0054101 A1 3/2007 Sigalas et al.
2007/0057415 A1 3/2007 Katagiri et al.
2007/0062644 A1 3/2007 Nakamura et al.
2007/0102199 A1 5/2007 Smith et al.
2007/0107899 A1 5/2007 Werner et al.
2007/0108060 A1 5/2007 Park
2007/0131912 A1 6/2007 Simone et al.
2007/0151009 A1 7/2007 Conrad, III et al.
2007/0151769 A1 7/2007 Slutz et al.
2007/0181224 A1 8/2007 Marya et al.
2007/0187095 A1 8/2007 Walker et al.
2007/0207182 A1 9/2007 Weber et al.
2007/0221373 A1 9/2007 Murray
2007/0227745 A1 10/2007 Roberts et al.
2007/0259994 A1 11/2007 Tour et al.
2007/0270942 A1 11/2007 Thomas
2007/0284112 A1 12/2007 Magne et al.
2007/0299510 A1 12/2007 Venkatraman et al.
2008/0011473 A1 1/2008 Wood et al.
2008/0020923 A1 1/2008 Debe et al.
2008/0041500 A1 2/2008 Bronfin
2008/0047707 A1 2/2008 Boney et al.
2008/0060810 A9 3/2008 Nguyen et al.
2008/0081866 A1 4/2008 Gong et al.
2008/0093073 A1 4/2008 Bustos et al.
2008/0121436 A1 5/2008 Slay et al.
2008/0127475 A1 6/2008 Griffo
2008/0149325 A1 6/2008 Crawford
2008/0149345 A1 6/2008 Marya et al.
2008/0149351 A1 6/2008 Marya et al.
2008/0169130 A1 7/2008 Norman et al.
2008/0175744 A1 7/2008 Motegi
2008/0179104 A1 7/2008 Zhang et al.
2008/0196801 A1 8/2008 Zhao et al.
2008/0202764 A1 8/2008 Clayton et al.
2008/0202814 A1 8/2008 Lyons et al.
2008/0210473 A1 9/2008 Zhang et al.
2008/0216383 A1 9/2008 Pierick et al.
2008/0220991 A1 9/2008 Slay et al.
2008/0223587 A1 9/2008 Cherewyk
2008/0236829 A1 10/2008 Lynde
2008/0236842 A1 10/2008 Bhavsar et al.
2008/0248205 A1 10/2008 Blanchet et al.
2008/0248413 A1 10/2008 Ishii et al.
2008/0264205 A1 10/2008 Zeng et al.
2008/0264594 A1 10/2008 Lohmueller et al.
2008/0277980 A1 11/2008 Koda et al.
2008/0282924 A1 11/2008 Saenger et al.
2008/0296024 A1 12/2008 Huang et al.
2008/0302538 A1 12/2008 Hofman
2008/0314581 A1 12/2008 Brown
2008/0314588 A1 12/2008 Langlais et al.
2009/0038858 A1 2/2009 Griffo et al.
2009/0044946 A1 2/2009 Shasteen et al.
2009/0044955 A1 2/2009 King et al.
2009/0050334 A1 2/2009 Marya et al.
2009/0056934 A1 3/2009 Xu
2009/0065216 A1 3/2009 Frazier
2009/0068051 A1 3/2009 Gross
2009/0074603 A1 3/2009 Chan et al.
2009/0084600 A1 4/2009 Severance
2009/0090440 A1 4/2009 Kellett
2009/0107684 A1 4/2009 Cooke, Jr.
2009/0114381 A1 5/2009 Stroobants
2009/0116992 A1 5/2009 Lee
2009/0126436 A1 5/2009 Fly et al.
2009/0151949 A1 6/2009 Marya et al.
2009/0152009 A1 6/2009 Slay et al.
2009/0155616 A1 6/2009 Thamida
2009/0159289 A1 6/2009 Avant et al.
2009/0194745 A1 8/2009 Tanaka
2009/0205841 A1 8/2009 Kluge et al.
2009/0211770 A1 8/2009 Nutley et al.
2009/0226340 A1 9/2009 Marya
2009/0226704 A1 9/2009 Kauppinen et al.
2009/0242202 A1 10/2009 Rispler et al.
2009/0242208 A1 10/2009 Bolding
2009/0255667 A1 10/2009 Clem et al.
2009/0255684 A1 10/2009 Bolding
2009/0255686 A1 10/2009 Richard et al.
2009/0260817 A1 10/2009 Gambier et al.
2009/0266548 A1 10/2009 Olsen et al.
2009/0272544 A1 11/2009 Giroux et al.
2009/0283270 A1 11/2009 Langeslag
2009/0293672 A1 12/2009 Mirchandani et al.
2009/0301730 A1 12/2009 Gweily
2009/0308588 A1 12/2009 Howell et al.
2009/0317556 A1 12/2009 Macary
2009/0317622 A1 12/2009 Huang et al.
2010/0003536 A1 1/2010 Smith et al.
2010/0012385 A1 1/2010 Drivdahl et al.
2010/0015002 A1 1/2010 Barrera et al.
2010/0015469 A1 1/2010 Romanowski
2010/0025255 A1 2/2010 Su et al.
2010/0038076 A1 2/2010 Spray et al.
2010/0038595 A1 2/2010 Imholt et al.

(56) References Cited

U.S. PATENT DOCUMENTS

2010/0040180 A1 2/2010 Kim et al.
2010/0044041 A1 2/2010 Smith et al.
2010/0051278 A1 3/2010 Mytopher et al.
2010/0055492 A1 3/2010 Baroum et al.
2010/0089583 A1 4/2010 Xu et al.
2010/0116495 A1 5/2010 Spray
2010/0119405 A1 5/2010 Okamoto et al.
2010/0139930 A1 6/2010 Patel et al.
2010/0161031 A1 6/2010 Papirov et al.
2010/0200230 A1 8/2010 East, Jr. et al.
2010/0236793 A1 9/2010 Bjorgum
2010/0236794 A1 9/2010 Duan et al.
2010/0243254 A1 9/2010 Murphy et al.
2010/0252273 A1 10/2010 Duphorne
2010/0252280 A1 10/2010 Swor et al.
2010/0270031 A1 10/2010 Patel
2010/0276136 A1 11/2010 Evans et al.
2010/0276159 A1 11/2010 Mailand et al.
2010/0282338 A1 11/2010 Gerrard et al.
2010/0282469 A1 11/2010 Richard et al.
2010/0297432 A1 11/2010 Sherman et al.
2010/0304178 A1 12/2010 Dirscherl
2010/0304182 A1 12/2010 Facchini et al.
2010/0314105 A1 12/2010 Rose
2010/0314127 A1 12/2010 Swor et al.
2010/0319427 A1 12/2010 Lohbeck et al.
2010/0326650 A1 12/2010 Tran et al.
2011/0005773 A1 1/2011 Dusterhoft et al.
2011/0036592 A1 2/2011 Fay
2011/0048743 A1 3/2011 Stafford et al.
2011/0052805 A1 3/2011 Bordere et al.
2011/0067872 A1 3/2011 Agrawal
2011/0067889 A1 3/2011 Marya et al.
2011/0091660 A1 4/2011 Dirscherl
2011/0094406 A1 4/2011 Marya et al.
2011/0135530 A1 6/2011 Xu et al.
2011/0135805 A1 6/2011 Doucet et al.
2011/0139465 A1 6/2011 Tibbles et al.
2011/0147014 A1 6/2011 Chen et al.
2011/0186306 A1 8/2011 Marya et al.
2011/0192613 A1 8/2011 Garcia et al.
2011/0214881 A1 9/2011 Newton et al.
2011/0221137 A1 9/2011 Obi et al.
2011/0236249 A1 9/2011 Kim et al.
2011/0247833 A1 10/2011 Todd et al.
2011/0253387 A1 10/2011 Ervin
2011/0259610 A1 10/2011 Shkurti et al.
2011/0277987 A1 11/2011 Frazier
2011/0277989 A1 11/2011 Frazier
2011/0277996 A1 11/2011 Cullick et al.
2011/0284232 A1 11/2011 Huang
2011/0284240 A1 11/2011 Chen et al.
2011/0284243 A1 11/2011 Frazier
2011/0300403 A1 12/2011 Vecchio et al.
2011/0314881 A1 12/2011 Hatcher et al.
2012/0046732 A1 2/2012 Sillekens et al.
2012/0067426 A1 3/2012 Soni et al.
2012/0080189 A1 4/2012 Marya et al.
2012/0090839 A1 4/2012 Rudic
2012/0097384 A1 4/2012 Valencia et al.
2012/0103135 A1 5/2012 Xu et al.
2012/0125642 A1 5/2012 Chenault
2012/0130470 A1 5/2012 Agnew et al.
2012/0145378 A1 6/2012 Frazier
2012/0145389 A1 6/2012 Fitzpatrick, Jr.
2012/0156087 A1 6/2012 Kawabata
2012/0168152 A1 7/2012 Casciaro
2012/0177905 A1 7/2012 Seals et al.
2012/0190593 A1 7/2012 Soane et al.
2012/0205120 A1 8/2012 Howell
2012/0205872 A1 8/2012 Reinhardt et al.
2012/0211239 A1 8/2012 Kritzler et al.
2012/0234546 A1 9/2012 Xu
2012/0234547 A1 9/2012 O'Malley et al.
2012/0247765 A1 10/2012 Agrawal et al.
2012/0267101 A1 10/2012 Cooke, Jr.
2012/0269673 A1 10/2012 Koo et al.
2012/0273229 A1 11/2012 Xu et al.
2012/0318513 A1 12/2012 Mazyar et al.
2013/0000985 A1 1/2013 Agrawal et al.
2013/0008671 A1 1/2013 Booth
2013/0017610 A1 1/2013 Roberts et al.
2013/0022816 A1 1/2013 Smith et al.
2013/0029886 A1 1/2013 Mazyar et al.
2013/0032357 A1 2/2013 Mazyar et al.
2013/0043041 A1 2/2013 McCoy et al.
2013/0047785 A1 2/2013 Xu
2013/0052472 A1 2/2013 Xu
2013/0056215 A1 3/2013 Crews
2013/0068411 A1 3/2013 Forde et al.
2013/0068461 A1 3/2013 Maerz et al.
2013/0084643 A1 4/2013 Commarieu et al.
2013/0105159 A1 5/2013 Alvarez et al.
2013/0112429 A1 5/2013 Crews
2013/0126190 A1 5/2013 Mazyar et al.
2013/0133897 A1 5/2013 Bailhly et al.
2013/0144290 A1 6/2013 Schiffl et al.
2013/0146144 A1 6/2013 Joseph et al.
2013/0160992 A1 6/2013 Agrawal et al.
2013/0167502 A1 7/2013 Wilson et al.
2013/0168257 A1 7/2013 Mazyar et al.
2013/0186626 A1 7/2013 Aitken et al.
2013/0199800 A1 8/2013 Kellner et al.
2013/0209308 A1 8/2013 Mazyar et al.
2013/0220496 A1 8/2013 Inoue et al.
2013/0240200 A1 9/2013 Frazier
2013/0240203 A1 9/2013 Frazier
2013/0261735 A1 10/2013 Pacetti et al.
2013/0277044 A1 10/2013 King et al.
2013/0310961 A1 11/2013 Velez
2013/0048289 A1 12/2013 Mazyar
2013/0319668 A1 12/2013 Tschetter et al.
2013/0327540 A1 12/2013 Hamid et al.
2014/0018489 A1 1/2014 Johnson
2014/0020712 A1 1/2014 Benson
2014/0027128 A1 1/2014 Johnson
2014/0060834 A1 3/2014 Quintero
2014/0093417 A1 4/2014 Liu
2014/0110112 A1 4/2014 Jordan, Jr.
2014/0116711 A1 5/2014 Tang
2014/0124216 A1 5/2014 Fripp et al.
2014/0154341 A1 6/2014 Manuel et al.
2014/0186207 A1 7/2014 Bae et al.
2014/0190705 A1 7/2014 Fripp
2014/0196889 A1 7/2014 Jordan et al.
2014/0202284 A1 7/2014 Kim
2014/0202708 A1 7/2014 Jacob et al.
2014/0219861 A1 8/2014 Han
2014/0224477 A1 8/2014 Wiese et al.
2014/0236284 A1 8/2014 Stinson
2014/0271333 A1 9/2014 Kim et al.
2014/0286810 A1 9/2014 Marya
2014/0305627 A1 10/2014 Manke
2014/0311731 A1 10/2014 Smith
2014/0311752 A1 10/2014 Streich et al.
2014/0360728 A1 12/2014 Tashiro et al.
2014/0374086 A1 12/2014 Agrawal et al.
2015/0060085 A1 3/2015 Xu
2015/0065401 A1 3/2015 Xu et al.
2015/0102179 A1 4/2015 McHenry et al.
2015/0184485 A1 7/2015 Xu et al.
2015/0240337 A1 8/2015 Sherman et al.
2015/0247376 A1 9/2015 Tolman
2015/0299838 A1 10/2015 Doud
2015/0354311 A1 12/2015 Okura et al.
2016/0024619 A1 1/2016 Wilks
2016/0128849 A1 5/2016 Yan et al.
2016/0201425 A1 7/2016 Walton
2016/0201427 A1 7/2016 Fripp
2016/0201435 A1 7/2016 Fripp et al.
2016/0209391 A1 7/2016 Zhang et al.
2016/0230494 A1 8/2016 Fripp et al.
2016/0251934 A1 9/2016 Walton
2016/0258242 A1 9/2016 Hayter et al.

(56) References Cited

U.S. PATENT DOCUMENTS

| | | | |
|---|---|---|---|
| 2016/0265091 | A1 | 9/2016 | Walton et al. |
| 2016/0272882 | A1 | 9/2016 | Stray et al. |
| 2016/0279709 | A1 | 9/2016 | Xu et al. |
| 2017/0050159 | A1 | 2/2017 | Xu et al. |
| 2017/0266923 | A1 | 9/2017 | Guest et al. |
| 2017/0356266 | A1 | 12/2017 | Arackakudiyil et al. |
| 2018/0010217 | A1 | 1/2018 | Wilks et al. |
| 2018/0023359 | A1 | 1/2018 | Xu |
| 2018/0178289 | A1 | 6/2018 | Xu et al. |
| 2018/0187510 | A1 | 7/2018 | Xu et al. |
| 2018/0216431 | A1 | 8/2018 | Walton et al. |
| 2018/0274317 | A1 | 9/2018 | Hall |
| 2019/0054523 | A1 | 2/2019 | Wolf et al. |
| 2019/0093450 | A1 | 3/2019 | Walton et al. |
| 2019/0203563 | A1 | 7/2019 | Gano et al. |
| 2019/0249510 | A1 | 8/2019 | Deng et al. |

FOREIGN PATENT DOCUMENTS

| | | |
|---|---|---|
| CA | 2886988 | 10/2015 |
| CN | 1076968 | 10/1993 |
| CN | 1079234 | 12/1993 |
| CN | 1255879 | 6/2000 |
| CN | 1668545 | 9/2005 |
| CN | 1882759 | 12/2006 |
| CN | 101050417 | 10/2007 |
| CN | 101351523 | 1/2009 |
| CN | 101381829 | 3/2009 |
| CN | 101392345 | 3/2009 |
| CN | 101454074 | 6/2009 |
| CN | 101457321 | 6/2009 |
| CN | 101605963 | 12/2009 |
| CN | 101720378 | 6/2010 |
| CN | 102517489 | 6/2012 |
| CN | 102796928 | 11/2012 |
| CN | 103343271 | 10/2013 |
| CN | 103602865 | 2/2014 |
| CN | 103898384 | 7/2014 |
| CN | 104004950 | 8/2014 |
| CN | 104152775 | 11/2014 |
| CN | 104480354 | 4/2015 |
| CN | 201532089 | 4/2015 |
| CN | 104651692 | 5/2015 |
| CN | 10577976 | 7/2016 |
| CN | 106086559 | 11/2016 |
| EA | 200600343 | 6/2006 |
| EA | 200870227 | 2/2009 |
| EP | 0033625 | 8/1981 |
| EP | 0400574 | 5/1990 |
| EP | 0470599 | 2/1998 |
| EP | 1006258 | 1/2000 |
| EP | 1174385 | 1/2002 |
| EP | 1412175 | 4/2004 |
| EP | 1493517 | 1/2005 |
| EP | 1798301 | 6/2007 |
| EP | 1857570 | 11/2007 |
| EP | 2088217 | 8/2009 |
| GB | 912956 | 12/1962 |
| GB | 1046330 | 10/1966 |
| GB | 1280833 | 7/1972 |
| GB | 1357065 | 6/1974 |
| GB | 2095288 | 9/1982 |
| GB | 2529062 | 2/2016 |
| JP | H10147830 | 6/1998 |
| JP | 2000073152 | 3/2000 |
| JP | 2000185725 | 7/2000 |
| JP | 2002053902 | 2/2002 |
| JP | 2004154837 | 6/2004 |
| JP | 2004225084 | 8/2004 |
| JP | 2004225765 | 8/2004 |
| JP | 2005076052 | 3/2005 |
| JP | 2008266734 | 11/2008 |
| JP | 2008280565 | 11/2008 |
| JP | 2009144207 | 7/2009 |
| JP | 2010502840 | 1/2010 |
| JP | 2012197491 | 10/2012 |
| JP | 2013019030 | 1/2013 |
| JP | 2014043601 | 3/2014 |
| KR | 20130023707 | 3/2013 |
| RU | 2373375 | 7/2006 |
| WO | 9111587 | 8/1881 |
| WO | WO1990002655 | 3/1990 |
| WO | 9200961 | 1/1992 |
| WO | 1992013978 | 8/1992 |
| WO | 9857347 | 12/1998 |
| WO | 9909227 | 2/1999 |
| WO | 1999027146 | 6/1999 |
| WO | 9947726 | 9/1999 |
| WO | 2001001087 | 1/2001 |
| WO | 2004001087 | 12/2003 |
| WO | 2004073889 | 9/2004 |
| WO | 2005065281 | 7/2005 |
| WO | 2007044635 | 4/2007 |
| WO | 2007095376 | 8/2007 |
| WO | 2008017156 | 2/2008 |
| WO | 2008034042 | 3/2008 |
| WO | 2008057045 | 5/2008 |
| WO | 2008079485 | 7/2008 |
| WO | 2008079777 | 7/2008 |
| WO | 2008142129 | 11/2008 |
| WO | 2009055354 | 4/2009 |
| WO | 2009079745 | 7/2009 |
| WO | 2009093420 | 7/2009 |
| WO | 2010012184 | 2/2010 |
| WO | 2010038016 | 4/2010 |
| WO | 2010083826 | 7/2010 |
| WO | 2010110505 | 9/2010 |
| WO | 2011071902 | 6/2011 |
| WO | 2011071907 | 6/2011 |
| WO | 2011071910 | 6/2011 |
| WO | 2011130063 | 10/2011 |
| WO | 2012015567 | 2/2012 |
| WO | 2012071449 | 5/2012 |
| WO | 2012091984 | 7/2012 |
| WO | 2012149007 | 11/2012 |
| WO | 2012164236 | 12/2012 |
| WO | 2012174101 | 12/2012 |
| WO | 2012175665 | 12/2012 |
| WO | 2013019410 | 2/2013 |
| WO | 2013019421 | 2/2013 |
| WO | 2013053057 | 4/2013 |
| WO | 2013078031 | 5/2013 |
| WO | 2013109287 | 7/2013 |
| WO | 2013122712 | 8/2013 |
| WO | 2013154634 | 10/2013 |
| WO | 2014100141 | 6/2014 |
| WO | 2014113058 | 7/2014 |
| WO | 2014121384 | 8/2014 |
| WO | 2014210283 | 12/2014 |
| WO | 2015127177 | 8/2015 |
| WO | 2015142862 | 9/2015 |
| WO | 2015161171 | 10/2015 |
| WO | 2015171126 | 11/2015 |
| WO | 2015171585 | 11/2015 |
| WO | 2016024974 | 2/2016 |
| WO | 2016032490 | 3/2016 |
| WO | 2016032493 | 3/2016 |
| WO | 2016032619 | 3/2016 |
| WO | 2016032620 | 3/2016 |
| WO | 2016032621 | 3/2016 |
| WO | 2016032758 | 3/2016 |
| WO | 2016032761 | 3/2016 |
| WO | 2016036371 | 3/2016 |
| WO | 2016085798 | 6/2016 |
| WO | 2016165041 | 10/2016 |
| WO | 2020018110 | 1/2020 |
| WO | 2020109770 | 6/2020 |

OTHER PUBLICATIONS

Hillis et al., "High Purity Magnesium AM60 Alloy: The Critical Contaminant Limits and the Salt Water Corrosion Performance", SAE Technical Paper Series (1986).

(56) References Cited

OTHER PUBLICATIONS

Pawar, S.G., "Influence of Microstructure on the Corrosion Behaviour of Magnesium Alloys", PhD Dissertation, University of Manchester (2011).
Czerwinski, "Magnesium Injection Molding"; Technology & Engineering; Springer Science + Media, LLC, pp. 107-108, (Dec. 2007).
Metals Handbook, Desk Edition, edited by J.R. David, published by ASM International, pp. 559-574 (1998).
Hassan et al., "Development of high strength magnesium based composites using elemental nickel particulates as reinforcement", Journal of Materials Science, vol. 37, pp. 2467-2474 (2002).
Machine Translation of CN103898384 (originally submitted in Information Disclosure Statement filed Sep. 24, 2020).
Machine Translation of KR 20130023707 (originally cited in Information Disclosure Statement filed Sep. 24, 2020).
Machine Translation of CN103602865 (originally cited in Information Disclosure Statement filed Sep. 24, 2020).
Machine Translation of CN101381829 (originally cited in Information Disclosure Statement filed Sep. 11, 2020).
Machine Translation of CN102518489 (originally cited in Information Disclosure Statement filed Sep. 11, 2020).
Machine Translation of CN 103343271 (originally cited in Information Disclosure Statement filed Sep. 11, 2020).
Machine Translation of CN102796928 (originally cited in Information Disclosure Statement filed Sep. 11, 2020).
Machine Translation of JP2008266734 (originally cited in Information Disclosure Statement filed Sep. 11, 2020 ).
Machine Translation of JP2012197491 (originally cited in Information Disclosure Statement filed Sep. 11, 2020).
Machine Translation of JP2013019030 (originally cited in Information Disclosure Statement filed Sep. 11, 2020).
Machine Translation of JP2014043601 (originally cited in Information Disclosure Statement filed Sep. 11, 2020).
Machine Translation of CN104004950 (See Foreign Patent Document # 2).
Machine Translation of CN104651691 (See Foreign Patent Document # 3).
Ashby, "Teach Yourself Phase Diagrams and Phase Transformations", Cambridge, 5th Edition, pp: unknown (Mar. 2009).
Callister, Materials Science and Engineering An Introduction:, 6th Edition, New York, pp: unknown (2003).
Hanson et al. Constitution of Binary Alloys:, McGraw-Hill Book Co. Inc., pp: unknown (1958).
MSE 2090: Introduction to Materials Science, Chapter 9, pp: unknown (date unknown).
Metals Handbook, "Metallography, Structures and Phase Diagrams", Aluminum-Magnesium, American Society For Metals, 8th Edition, vol. 8, pp: unknown (1973).
Metals Handbook, "Metallography, Structures and Phase Diagrams", Magnesium-Nickel, American Society For Metals, 8th Edition, vol. 8, pp: unknown (1973).
Principles and Prevention of Corrosion, "Volts versus saturated calomel reference electrobe", D.A. Jones, p. 170 (1996).
Medlin, "Mass Balance", handwritten notes (Nov. 2020).
Metals Handbook, "Metallography, Structures and Phase Diagrams", Aluminum-Iron, American Society For Metals, 8th Edition, vol. 8, p. 260 (1973).
Metals Handbook, "Metallography, Structures and Phase Diagrams", Aluminum-Nickel, American Society For Metals, 8th Edition, vol. 8, p. 261 (1973).
Metals Handbook, "Metallography, Structures and Phase Diagrams", Aluminum-Copper, American Society For Metals, 8th Edition, vol. 8, p. 259 (1973).
Metals Handbook, "Metallography, Structures and Phase Diagrams", Silver-Aluminum, American Society For Metals, 8th Edition, vol. 8, p. 252 (1973).
Medlin, Declaration of Dona J. Medlin Ph D., P.E., FASM Under 37 CFR Section 1.68 in Support of Petition For Inter Partes Review of U.S. Pat. No. 9,903,010 (Sep. 2020).
Li, Qiang, "Translation Declaration and Translation of China Patent Publication No. 103343271" (Jun. 2020).
Ho et al., The mechanical behavior of magnesium alloy AZ91 reinforced with fine copper particulates:, Materials Science and Engineering A369, pp. 302-308 (2004).
Trojanova et al., "Mechanical and fracture properties of an AZ91 Magnesium alloy reinforced by Si and SiC particles", Composites Science and Technology, vol. 69, pp. 2256-2264 (2009).
Lin et al., "Formation of Magnesium Metal Matrix Composites Al2O3p/AZ91D and Their Mechanical Properties After Heat Treatment" Acta Metallurgica Slovaca, vol. 16, pp. 237-245 (2010).
National Physical Laboratory, "Bimetallic Corrosion" Crown (C) p. 1-14 (2000).
Hemanth, "Fracture Behavior of Cryogenically solidifed aluminum-alloy reinforced with Nano-ZrO2 Metal Matrix Composites (CNMMCs)", Journal of Chemical Engineering and Materials Science, vol. 2(8), pp. 110-121 (Aug. 2011).
Ye et al., "Review of recent studies in magnesium matrix composites", Journal of Material Science, vol. 39, pp. 6153-6171 (2004).
Hassan et al., "Development of a novel magnesium-copper based composite with improved mechanical properties", Materials Research Bulletin, vol. 37, pp. 377-389 (2002).
Ye et al., "Microstructure and tensile properties of Ti6A14V/AM60B magnesium matrix composite", Journal of Alloys and Composites, vol. 402, pp. 162-169 (2005).
Kumar et al., "Mechanical and Tribological Behavior of Particulate Reinforced Aluminum metal Matrix Composite", Journal of Minerals & Materials Characterization and Engineering, vol. 10, pp. 59-91 (2011).
Majumdar, "Micromechanics of Discontinuously Reinforced MMCs", Engineering Mechanics and Analysis of Metal-Matrix Composites, vol. 21, pp. 395-406.
Shimizu et al., "Multi-walled carbon nanotube-reinforced magnesium alloy composites", Scripta Materialia, vol. 58, pp. 267-270 (2008).
Zhan et al., "Single-wall carbon nanotubes as attractive toughening agents in alumina-based nanocomposites", Mature Materials, vol. 2, pp. 38-42 (Jan. 2003).
Curtin et al., "CNT-reinforced ceramics and metals", Materials Today, vol. 7, pp. 44-49 (2004).
Pardo et al., "Corrosion behavior of magnesium/aluminum alloys in 3.5 wt.% NaCl", Corrosion Science, vol. 50, pp. 323-834 (2008).
Song et L., "Influence of microstructure on the corrosion of diecast AZ91D", Corrosion Science, vol. 41, pp. 249-273 (1999).
Natarai, "Trend of Research and Development for Magnesium Alloys—Reducing the Weight of Structural Materials in Motor Vehicles", Science & Technology Trends, Quarterly Review, No. 18, pp. 84-97 (Jan. 2006).
Saravanan et al., "Mechanically Alloyed Carbon Nanotubes (CNT) Reinforced Nanocrystalline AA 4032: Synthesis and Characterization", Journal of Minerals & Materials Characterization & Engineering, vol. 9, No. 11, pp. 1027-1035 (2010).
Tsipas et al., "Effect of high energy ball milling on titanium-hydroxyapatite powders", Powder Metallurgy, vol. 46, No. 1 pp. 73-77 (2003).
Xie et al., "TEM Observation of Interfaces between Particles in Al—Mg Powder Compacts Prepared by Pulse Electric Current Sintering", Materials Transactions, vol. 43, No. 9, pp. 2177-2180 (2002).
Elsayed et al., "Effect of Consolidation and Extrusion Temperatures on Tensile Properties of Hot Extruded ZK61 Magnesium Alloy Gas Atomized Powders via Spark Plasma Sintering", Tranasctions of JWRI, vol. 38, No. 2, pp. 31.
Shigematsu et al., "Surface treatment of AZ91D magnesium alloy by aluminum diffusion coating", Journal of Materials Science Letters, vol. 19, pp. 473-475 (2000).
Spencer et al., "Fluidized Bed Polymer Particle ALD Process for Producing HDPE/Alumina Nanocomposites", 12th International Conference on Fluidization, vol. RP4 (2007).
Maisano, "Cryomilling of Aluminum-Based and Magnesium-Based Metal Powders", Thesis, Virginia Tech (Jan. 2006).

(56) References Cited

OTHER PUBLICATIONS

Walters et al., "A Study of Jets from Unsintered-Powder Metal Lined Nonprecision Small-Caliber Shaped Charges", Army Research Laboratory, Aberdeen Proving Group, MC 21005-5066 (Feb. 2001).
Sigworth et al. "Grain Refinement of Aluminum Castings Alloys" American Foundry Society; Paper 07-67; pp. 5-7 (2007).
Momentive, "Titanium Diborid Powder" condensed product brochure; retrieved from https:/www.momentive.com/WorkArea/DownloadAsset.aspx?id+27489.; p. 1 (2012).
Durbin, "Modeling Dissolution in Aluminum Alloys" Dissertation for Georgia Institute of Technology; retrieved from https://smartech;gatech/edu/bitstream/handle/1853/6873/durbin_tracie_L_200505_phd.pdf> (2005).
Pegeut et al., "Influence of cold working on the pitting corrosion resistance of stainless steel" Corrosion Science, vol. 49, pp. 1933-1948 (2007).
Elemental Charts from chemicalelements.com; retrieved Jul. 27, 2017.
Song et al., "Corrosion Mechanisms of Magnesium Alloys" Advanced Engg Materials, vol. 1, No. 1 (1999).
Zhou et al., "Tensile Mechanical Properties and Strengthening Mechanism of Hybrid Carbon Nanotubes . . . " Journal of Nanomaterials, 2012; 2012:851862 (doi: 10 1155/2012/851862) Figs. 6 and 7.
Trojanova et al., "Mechanical and Acoustic Properties of Magnesium Alloys . . . " Light Metal Alloys Application, Chapter 8, Published Jun. 11, 2014 (doi: 10.5772/57454) p. 163, para. [0008], [0014-0015]; [0041-0043].
AZoNano "Silicon Carbide Nanoparticles—Properties, Applications" http://www.amazon.com/articles.aspx?ArticleD=3396) p. 2, Physical Properties, Thermal Properties (May 9, 2013).
AZoM "Magnesium AZ91D-F Alloy" http://www.amazon.com/articles.aspx?ArticleD=8670) p. 1, Chemical Composition; p. 2 Physical Properties (Jul. 31, 2013.
Elasser et al., "Silicon Carbide Benefits and Advantages . . . " Proceedings of the IEEE, 2002; 906(6):969-986 (doi: 10.1109/JPROC.2002.1021562) p. 970, Table 1.
Lan et al., "Microstructure and Microhardness of SiC Nanoparticles . . . " Materials Science and Engineering A 386:284-290 (2004).
Casati et al., "Metal Matrix Composites Reinforced by Nanoparticles", vol. 4:65-83 (2014).
United States District Court / Western District of Oklahoma, Case No. 5:21-cv-1115, *Magnesium Machine LLC* v. *Terves LLC*, Docket Report (Jan. 24, 2023).
United States District Court/Northern District of Ohio, Case No. 1:19-cv-1611, *Terves LLC* v. *Yueyang Aerospace New Materials Co. Ltd.*, Partial Docket Report (Jan. 24, 2023).
U.S. Court of Appeals / Federal District, *Terves LLC* v. *Yueyang Aerospace New Materials Co. Ltd*., Docket Report (Jan. 24, 2023).
United States District Court / West District of Oklahoma, Case No. 5:21-cv-1115, *Magnesium Machine, LLC* v. *Terves LLC*, "Complaint for Declaration Judgment of Non-Infringment, Invalidity, and Unenforceability of Patents, Tortious Interference Contract and Prospective Economic Advantage and Unfair Competition" (Nov. 23, 2021).
United States District Court / Northern District of Ohio, Eastern Division, Case No. 1:19-cv-1611, *Terves LLC* v. *Yueyang Aerospace New Materials Co. Ltd*., "Memorandum in Support of Defendants' Motion for Summary Judgment" (Nov. 18, 2021).
Patent Trial and Appeal Board / Federal District, *Chongqing Yanmei Technology Co., LTD* v. *Terves LLC*; Declaration Under 37 CFR 1.68 of Dr. Juan C. Nava, Ph.D. (filed Jan. 24, 2023).
Curriculum Vitae of Dr. Juan C. Nava, Ph.D.
Patent Trial and Appeal Board / Federal District, *Chongqing Yanmei Technology Co., LTD* v. *Terves LLC*; "Petition for Inter Partes Review of U.S. Pat. No. 10,689,740" (filed Jan. 24, 2023).
United States District Court/Northern District of Ohio/Eastern Division, Supplemental Declaration of Dana J. Medlin, Ph.D. in Support of Opposition to Terves LLC'S Motion for Preliminary Injunction in related Case 1:19-CV-1611 (filedOct. 15, 2020).
United States District Court/Northern District of Ohio/Eastern Division, Declaration of Andrew Sherman in Support of Terves' Preliminary Injunction Motion in related Case 1:19-CV-1611 (filed May 1, 2020).
United States District Court/Northern District of Ohio/Eastern Division, Memorandum Opinion and Order in related Case 1:19-CV-1611 (issued Mar. 29, 2021).
United States District Court/Northern District of Ohio/Eastern Division, Second Rebuttal Rule 26 Report of Lee A. Swanger, Ph.D., P.E. in related Case 1:19-CV-1611 (filed Nov. 24, 2020).
U.S. Patent and Trademark Office, Declaration of Dana J. Medlin in Support of Request for Ex Parte Reexamination of U.S. Pat. No. 10,329,653 (filed Jul. 6, 2021).
Saravanan et al., "Fabrication and characterization of pure magnesium-30 vol SiCP particle composite", Material Science and Eng., vol. 276, pp. 108-116 (2000).
Song et al., Texture evolution and mechanical properties of AZ31B magnesium alloy sheets processed by repeated unidirectional bending, Journal of Alloys and Compounds, vol. 489, pp. 475-481 (2010).
Blawert et al., "Magnesium secondary alloys: Alloy design for magnesium alloys with improved tolerance limits against impurities", Corrosion Science, vol. 52, No. 7, pp. 2452-2468 (Jul. 1, 2010).
Wang et al., "Effect of Ni on microstructures and mechanical properties of AZ1 02 magnesium alloys" Zhuzao Foundry, Shenyang Zhuzao Yanjiusuo, vol. 62, No. 1, pp. 315-318 (Jan. 1, 2013).
Kim et al., "Effect of aluminum on the corrosions characteristics of Mg—4Ni-xAl alloys", Corrosion, vol. 59, No. 3, pp. 228-237 (Jan. 1, 2003).
Unsworth et al., "A new magnesium alloy system", Light Metal Age, vol. 37, No. 7-8., pp. 29-32 (Jan. 1, 1979).
Geng et al., "Enhanced age-hardening response of Mg—Zn alloys via Co additions", Scripta Materialia, vol. 64, No. 6, pp. 506-509 (Mar. 1, 2011).
Zhu et al., "Microstructure and mechanical properties of Mg6ZnCuO.6Zr (wt.%) alloys", Journal of Alloys and Compounds, vol. 509, No. 8, pp. 3526-3531 (Dec. 22, 2010).
International Search Authority, International Search Report and Written Opinion for PCT/GB2015/052169 (dated Feb. 17, 2016).
Search and Examination Report for GB 1413327.6 (dated Jan. 21, 2015).
Magnesium Elektron Test Report (Mar. 8, 2005).
New England Fishery Management Counsel, "Fishery Management Plan for American Lobster Amendment 3" (Jul. 1989).
Emly, E.F., "Principles of Magnesium Technology" Pergamon Press, Oxford (1966).
Shaw, "Corrosion Resistance of Magnesium Alloys", ASM Handbook, vol. 13A, pp. 692-696 (2003).
Hanawalt et al., "Corrosion studies of magnesium and its alloys", Metals Technology, Technical Paper 1353 (1941).
The American Foundry Society, Magnesium alloys, casting source directory 8208, available at www.afsinc.org/files/magnes.pdf.
Rokhlin, "Magnesium alloys containing rare earth metals structure and properties", Advances in Metallic Alloys, vol. 3, Taylor & Francis (2003).
Ghali, "Corrosion Resistance of Aluminum and Magnesium Alloys" pp. 382-389, Wiley Publishing (2010).
Kim et al., "High Mechanical Strengths of Mg—Ni—Y and Mg—Cu Amorphous Alloys with Significant Supercooled Liquid Region", Materials Transactions, vol. 31, No. 11, pp. 929-934 (1990).
Tekumalla et al., "Mehcanical Properties of Magnesium-Rare Earth Alloy Systems", Metals, vol. 5, pp. 1-39 (2014).
State Intellectual Property Office of People's Republic of China, First Office Action for corresponding China Patent Application No. 201580020103.7 (dated Aug. 11, 2017).
Terves LLC, Response to First Office Action for China Patent Application No. 201580020103.7 (Official Translation dated Jul. 2, 2020).
Medlin, Dana, "Expert Report of Dana J. Medlin, Phd, PE, FASM in the Matter of *Terves LLC* v. *Yueyang Aerospace New Materials Co., Ltd., et al*.", US District Court for the Northern District Of Ohio, Eastern Division, Case No. 1:19-cv-1661 (Jul. 27, 2021.

(56) References Cited

OTHER PUBLICATIONS

Medlin, Dana,"Expert Rebuttal Report of Dana J. Medlin, Phd, PE, FASM", US District Court for the Northern District Of Ohio, Eastern Division, Case No. 1:19-cv-1661 (Aug. 27, 2021).
Yueyang Aerospace New Materials Co, Ltd, et al, "The Ecometal Defendant's Final Invalidity, Non-Infringement, and Unenforceability Contentions", US District Court for the Northern District Of Ohio, Eastern Division, Case No. 1:19-cv-1661 (Jul. 6, 2020 ).
Ralston and Birbilis, "Effect of Grain Size on Corrosion: A Review", Corrosion, vol. 66, No. 7, pp. 075005-01 thru 13 (2010).
Sherman, Andrew, "Declaration of Andrew J. Sherman Under 37 CFR § 1.132" in Ex Parte Reexamination of U.S. Appl. No. 90/014,795 (Jan. 14, 2021).
Swanger, Lee A., "Declaration of Lee A. Swanger, PhD, PE Under 37 CFR § 1.132" in Ex Parte Reexamination of U.S. Appl. No. 90/014,795 (Jan. 14, 2021).

| Sample | angle | loss (cc) |
|---|---|---|
| TAx-100E | 30 | 0.1301 |
| TAx-100E | 60 | 0.1483 |
| TAx-100E | 90 | 0.0442 |
| Gray Cast Iron | 30 | 0.0112 |
| Gray Cast Iron | 60 | 0.0257 |
| Gray Cast Iron | 90 | 0.0162 |
| TA-MMC170130-1 | 30 | 0.0049 |
| TA-MMC170130-1 | 60 | 0.0380 |
| TA-MMC170130-1 | 90 | 0.0323 |

Figure 8

DEGRADABLE METAL MATRIX COMPOSITE

The present invention is a divisional application of U.S. patent application Ser. No. 16/045,924 filed Jul. 26, 2018, which in turn claims priority on U.S. Provisional Application Ser. No. 62/537,707 filed Jul. 27, 2017, which are incorporated herein by reference.

TECHNICAL FIELD OF THE INVENTION

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations. In particular, the engineered degradable metal matrix composite of the present invention includes a core material and a degradable binder matrix, and which composite includes the following properties: A) repeating ceramic particle core material of 20-90 vol. %, B) degradable metallic binder/matrix, C) galvanically-active phases formed in situ from a melt and/or added as solid particles, D) degradation rate of 5-800 mg/cm$^2$/hr., or equivalent surface regression rates of 0.05-5 mm/hr. (and all values and ranges therebetween) in selected fluid environments such as, but not limited to, freshwater, brines and/or fracking liquids at a temperature of 35-200° C., and E) hardness exceeding 22 Rockwell C (ASTM E 18-07). The method of manufacturing the composite in accordance with the present invention includes the preparation of a plurality of ceramic particles, with or without galvanically-active materials such as, but not limited to, iron, nickel, copper, titanium, or cobalt, and infiltrating the ceramic particles with a degradable metal such as, but not limited to, magnesium, aluminum, magnesium alloy or aluminum alloy.

BACKGROUND OF THE INVENTION

The preparation of magnesium and aluminum degradable metal compositions, as well as degradable polymer compositions, has resulted in rapid commercialization of interventionless tools, including plugs, balls, valves, retainers, centralizers, and other applications. Generally, these products consist of materials that are engineered to dissolve or to corrode. Dissolving polymers and some powder metallurgy metals have been used in the oil and gas recovery industry.

While these prior art degradable systems have enjoyed success in reducing well completion costs, their ability to withstand deformation and to resist erosion in flowing fluid or to embed in steel casing are not suitable for a number of desired applications. For example, in the production of dissolving frac plugs, ceramic or steel inserts are currently used for gripping surfaces (to set the plug into the steel casing). Requirements for these grips include: a hardness higher than the steel casing; mechanical properties, including compression strength, deformation resistance (to retain a sharp edge); and fracture toughness that must be sufficient to withstand the setting operation where they are embedded slightly into the steel casing. Other applications such as 1) pump down seats currently fabricated from grey cast iron need to be milled out, and 2) frac balls or cones having very small overlaps with the seat (1/16" or less) currently have limited pressure ratings with dissolvable materials due to limited swaging or deformation resistance of current materials.

For applications such as seats and valve components and other sealing surfaces that are subjected to sand or proppant flow, existing magnesium, aluminum, or polymer alloy degradables have insufficient hardness and erosion resistance. In frac ball applications, metallic and polymer degradable balls deform, swage, and shear in such conditions, thereby limiting their pressure rating in small overlap (e.g., below 1/8" overlap) applications.

Sintered and cast products of metal matrix ceramic (MMC) plus metallic composites have been used in structural parts, wear parts, semiconductor substrates, printed circuit boards, high hardness and high precision machining materials (such as cutting tools, dies, bearings), and precision sinter molding materials, among other applications. These materials have found particular use in wear and high temperature highly loaded applications such as bearing sleeves, brake rotors, cutting tools, forming dies, and aerospace parts. Generally, these materials are selected from non-reactive components and are designed to not degrade, and the MMC and the cermets are formulated to resist all forms of corrosion/degradation, including wear and dissimilar metal corrosion.

To overcome the limitations of current degradable materials, a new material is required that has high strength, controlled degradation, and high hardness. Ideally, these high hardness degradable components and materials would also be able to be manufactured by a method that is low cost, scalable, and results in a controlled corrosion rate in a composite or alloy with similar or increased strength compared to traditional engineering alloys such as aluminum, magnesium, and iron and with hardnesses higher than cast iron. Ideally, traditional heat treatments, deformation processing and machining techniques could be used without impacting the dissolution rate and reliability of such components.

SUMMARY OF THE INVENTION

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations. In one non-limiting embodiment of the invention, the engineered degradable metal matrix composite includes a core material and a degradable binder matrix, and which composite includes the following properties: A) a repeating ceramic particle core material of 20-90 vol. % (and all values and arranges therebetween), B) a degradable metallic binder/matrix of 10-75 vol. % (and all values and arranges therebetween), C) galvanically-active phases formed in-situ from a melt or added as solid particles, D) a degradation rate being controlled to rates of 5-800 mg/cm$^2$/hr. (and all values and ranges therebetween), or equivalent surface regression rates of 0.05-5 mm/hr. (and all values and ranges therebetween) at a temperature of 35-200° C. (and all values and ranges therebetween) in 100-100,000 ppm (and all values and ranges therebetween) water or brines, and E) a hardness exceeding 22 (e.g., 22.01-60 Rockwell C and all values and ranges therebetween). Fluids seen in completion operations and which the composite of the present invention can be used in include 1) freshwater (generally 300-5000 ppm salt content), 2) drilling and completion brines including seawater which are generally chlorides and bromides of potassium, calcium, sodium, cesium, and zinc from about 5000 ppm to as high as 500,000 ppm or more, 3) some formates and acidic fluids, or 4) fluid produced or flowed back from the well formation which can include chlorides and carbonate salts. As can be appreciated, in some cases special fluids can be run in the well formation to cause or trigger the dissolution of the composite of the present invention, or a salt or chemical pills can be added to the fluid to cause or trigger the dissolution of the composite of the present invention. The present inventions also relates to the method of manufacturing the engineered degradable metal matrix composite of the present invention, which method includes the preparation of a plurality of ceramic particles, with or without galvanically-active materials such as, but not limited to, iron, nickel, copper, titanium, or cobalt, and infiltrating the ceramic particles with a degradable metal such as, but not limited to, magnesium or aluminum alloy.

In one non-limiting aspect of the invention, the invention relates to the formation of high hardness, wear-, deformation-, and erosion-resistant metal matrix composite materials that exhibit controlled degradation rates in aqueous media at temperatures that are at least 35° C., and typically about 35-200° C. (and all values and ranges therebetween) conditions. The ability to control the dissolution of a down hole well component in a variety of solutions is very important to the utilization of interventionless drilling, production, and completion tools such as sleeves, frac balls, hydraulic actuated tooling, scrapers, valves, screens, perforators and penetrators, knives, grips/slips, and the like. Reactive materials useful in this invention that dissolve or corrode when exposed to acid, salt, or other wellbore conditions have been proposed for some time. Incorporated by reference are U.S. Pat. Nos. 9,903,010; 9,757,796, and US Publication No. 2015/0239795 which describe techniques for creating and manufacturing dissolvable magnesium alloys through the addition of galvanically-active phases.

To obtain resistance to one type of degradation such as wear, but also to have high susceptibility to another type of corrosion such as aqueous corrosion, a composite containing two distinct phases was found to be required. One phase, being a high hardness phase, is present in large amounts (greater than 30 vol. %, and typically greater than 50 vol. %) of the composite. This high hardness phase provides resistance to wear and erosion and increases the hardness and deformation resistance of the composite. Useful deformation resistance is achieved by a second ceramic phase present in an amount of at least 10 vol. % in the composite. The deformation resistance can be enhanced by use of a higher aspect ratio ceramic phase. Useful hardness increases in the composite can be achieved with greater than 35% volumetric loading of the second ceramic phase, and can be further increased with increasing the loading. By selecting the right materials and controlling their percentages, distribution, and surface areas, novel composites can be fabricated that resist one type of degradation (namely wear or erosion) but are highly susceptible to other types of degradation (aqueous corrosion).

To achieve the desired degradation, galvanically-active phase(s) are required. This is achieved by adding a second phase either as a separate powder blended with the ceramic powder, a coating on the ceramic particles, and/or in situ by solidification or precipitation for the melt or solid solution. For example, when magnesium is selected as a degradable matrix alloy, the galvanically active phase in the magnesium matrix alloy can be formed of 1) iron and/or carbon (graphite) particle additions or coatings on ceramic particles, and/or 2) through the formation of $Mg_2M$ (where M is nickel, copper, or cobalt)-active intermetallics created during solidification from a highly alloyed melt. In terms of effectiveness for increasing corrosion rates, the following ranking can be used: Fe>Ni>Co>Cu, with carbon falling between nickel and copper depending on its structure. In another example, when aluminum or aluminum alloys are selected as the degradable matrix alloy, additions of gallium and/or indium are effective for managing corrosion, and such metals can be added as a coating on the ceramic particles, as intermetallic particles, and/or by adding as a solid solution from an aluminum alloy melt. Additional strengthening phases and solid solution material can be used to accelerate or inhibit corrosion rates. In general, aluminum and magnesium decrease corrosion rates, while zinc is neutral or can enhance corrosion rates. Corrosion rates of 0.02-5 mm/hr. (and all values and ranges therebetween) at a temperature of 35-200° C. for the composite can be achieved in freshwater or brine environments.

When the ceramic content is significant (greater than about 20 vol. %), the ceramic particles begin to block the corrosion process and inhibit the access of the aqueous solution to the degradable metal matrix. A 10-20 times decrease in degradation rates has been observed in a composite that includes 50 vol. % ceramic content. As such, the addition of ceramic content that is greater than about 20 vol. % has been found to result in a non-linear decrease in degradation rates. The decrease is generally more substantial with very fine particles of ceramic material (e.g., less than 100 micron). To compensate for a lower surface area exposed for dissolution due to a large inert loading of ceramic, a much higher dissolution rate in the matrix must be used to generate useful degradation rates. This can be accomplished by substituting more active catalysts (e.g., iron for nickel, nickel for copper), and by reducing the content of inhibiting phases (aluminum or other more cathodic metals). This may be done by moving to a ZK series alloy in magnesium from a WE or AZ series, for example. In general, the degradable matrix alloy and catalyst (galvanically-active phase) is selected to be 5-25 times as active (faster rate) than an equivalent non-composite system.

By selecting the right alloy chemistry and catalyst phase and its content (primarily exposed surface area), degradable MMCs are possible over temperatures ranging from 35-200° C., in low salinity (less than 1000 ppm dissolved solids, and typically 1-5 vol. % dissolved solids, normally KCl, NaCl), and heavy brines ($CaCl_2$, $CaBr_2$, $ZnBr_2$, carbonates, etc.). By reducing galvanically-active phases and adding inhibiting phases, materials having suitable corrosion/degradation rates in acidic media (such as 5 vol. % HCl or formic acid) can also be created.

In summary, the present invention relates to a degradable high hardness composite material that includes 1) plurality of ceramic particles having a hardness greater than 50 HRC and up to 10,000 VHN that forms 20-90 vol. % of the composite, 2) degradable alloy matrix selected from magnesium, aluminum, zinc, or their alloys that forms 10-75 vol. % of the composite, 3) plurality of degradation catalyst particles, zones, and/or regions that are galvanically-active (wherein such particles, zones, and/or regions contain one or more galvanically-active elements such as, but not limited to, iron, nickel, copper, cobalt, silver, gold, gallium, bismuth, lead, carbon or indium metals) and whose content is engineered to control degradation rates of 5-800 $mg/cm^2/hr$. (and all values and ranges therebetween), or equivalent surface regression rates of 0.05-5 mm/hr. (and all values and ranges therebetween) at a temperature of 35-200° C. (and all values and ranges therebetween) in 100-100,000 ppm (and all values and ranges therebetween) water or brines, and 4) ceramic particle content is 25-90 vol. % (and all values and ranges therebetween); to create a composite having a hardness of greater than 22 Rockwell C (ASTM E-18), and typically greater than 30 Rockwell C, and typically up to 70 Rockwell C (and all values and ranges therebetween).

The ceramic or intermetallic particles in the degradable high hardness composite material can be selected from metal carbides, borides, oxides, silicides, or nitrides such as, but not limited to, SiC, $B_4C$, $TiB_2$, TiC, $Al_2O_3$, MgO, SiC, $Si_3N_4$, $ZrO_2$, $ZrSiO_4$, $SiB_6$, SiAlON, WC, or other high hardness ceramic or intermetallic phases. The particles can be hollow or solid.

The ceramic or intermetallic particles in the degradable high hardness composite material can have a particle size of 0.1-1000 microns (and all values and ranges therebetween), and typically 5-100 microns, and may optionally have a broad or multimodal distribution of sizes to increase ceramic content.

Some or all of the ceramic or intermetallic particles in the degradable high hardness composite material can be shards, fragments, preformed or machined shapes, flakes, or other large particles with dimensions of 0.1-4 mm (and all values and ranges therebetween).

The surface coating on the ceramic or intermetallic particles can include nickel, iron, cobalt, titanium, nickel and/or copper to control dissolution and wetting as well as provide some or all of the galvanic activation. The surface coating on the ceramic or intermetallic particles can include magnesium, zinc, aluminum, tin, titanium, nickel, copper and/or other wetting agent to facilitate melt infiltration and/or particle distribution. The surface coating thickness is generally at least 60 nm and typically up to about 100 microns (and all values and ranges therebetween). The surface coating generally constitutes at least 0.1 wt. % of the coated ceramic or intermetallic particle, and typically constitutes up to 15 wt. % of the coated ceramic or intermetallic particle (and all values and ranges therebetween). The ceramic or intermetallic particles can be coated by a variety of coating techniques (e.g., chemical vapor deposition, wurster coating, physical vapor deposition, hydrometallurgy processes and other chemical or physical methods.

The particle surface of the ceramic or intermetallic particles can be modified with metal particles or other techniques to control the spacing of the ceramic particles, such as through the addition of titanium, zirconium, niobium, vanadium, and/or chromium active metal particles. Generally, these metal particles constitute about 0.1-15 wt. % (and all values and ranges therebetween) of the coated ceramic or intermetallic particles. It has been found that by coating the ceramic or intermetallic particles with such metals prior to adding the matrix metal, the metal coating facilitates in the building of a metal layer on the ceramic or intermetallic particles to create a boundary between the ceramic or intermetallic particles in the final composite, thereby effectively separating the ceramic or intermetallic particles in the final composite by at least 1.2 and typically at least 2× the coating thickness of the metal coating on the ceramic or intermetallic particles that exist on the ceramic or intermetallic particles prior to the addition of the matrix metal.

The degradable alloy matrix includes magnesium, aluminum, zinc, and their combinations and alloys which forms 10-75 vol. % of the composite, and the composite may optionally contain one or more active metals such as calcium, barium, indium, gallium, lithium, sodium, or potassium. Such active metals, when used, constitute about 0.05-10 wt. % (and all values and ranges therebetween) of the metal matrix material.

The degradation rate of the degradable high hardness composite material can be 0.01-5 mm/hr. (and all values and ranges therebetween) in fresh water or brines at a temperature of 35-200° C. (and all values and ranges therebetween).

The degradation rate of the degradable high hardness composite material can be engineered to be 0.05-5 mm/hr. (and all values and ranges therebetween) in a selected brine composition with a total dissolved solids of 300-300,000 ppm (and all values and ranges therebetween) of chloride, bromide, formate, or carbonate brines at selected temperatures of 35-200° C. (and all values and ranges therebetween).

The degradable high hardness composite material can have a compression strength of greater than 40 ksi, and typically greater than 80 ksi, and more typically greater than 100 ksi.

The degradable high hardness composite material can be fabricated by powder metallurgy, melt infiltration, squeeze casting, or other metallurgical process to create a greater than 92% pore-free structure, and typically greater than 98% pore-free structure.

The degradable high hardness composite material can be deformed and/or heat treated to develop improved mechanical properties, reduce porosity, or to form net shape or near net shape dimensions.

The degradable high hardness composite material can be useful in oil and gas or other subterranean operations, including a seat, seal, ball, sleeve, grip, slip, valve, valve component, spring, retainer, scraper, poppet, penetrator, perforator, shear, blade, insert, or other component requiring wear, erosion, or deformation resistance, edge retention, or high hardness.

The degradable high hardness composite material can be used as a portion of a component or structure, such as a surface coating or cladding, an insert, sleeve, ring, or other limited volume portion of a component or system The degradable high hardness composite material can be applied to a component surface through a cold spray, thermal spray, or plasma spray process The degradable high hardness composite material can be fabricated using pressure-assisted or pressureless infiltration of a bed of ceramic particles, wherein the galvanic catalyst, dopant, or phase is formed in situ (from solidification and precipitation of the melt), ex situ (from addition of particles or coatings in the powder bed or preform) sources, and/or formed in situ prior to or during infiltration or composite preparation.

The degradable high hardness composite material can be fabricated through powder metallurgy processes, including mixing of powders, compacting, and sintering, or alternate isostatic pressing, spark plasma sintering, powder forging, injection molding, or similar processes to produce the desired composite.

The degradable high hardness composite material can have a ceramic phase that contains flakes, platelets, whiskers, or short fibers with an aspect ratio of at least 4:1, and typically 10:1 or more.

These and other advantages of the present invention will become more apparent to those skilled in the art from a review of the figures and the description of the embodiments and claims.

BRIEF DESCRIPTION OF FIGURES

FIG. 1 illustrates a composite formed of ceramic particles 12 in a dissolvable metallic matrix 10. FIG. 2 illustrates a composite formed of ceramic particles 16 in a water degradable matrix 14 with the entire composite surrounded by a protective coating 18 (e.g., degradable polymer material, degradable metal) wherein the coating is triggered to degrade or is removed by some method. FIG. 3 illustrates a composite formed of degradable matrix 20 with ceramic particles 22 and platelet or fiber mechanically reinforcement from flakes, platelets, or fibers 24.

FIG. 5 is a magnesium-coated graphite, consolidated magnesium-germanium part, and microstructure of $Mg_2B_4C$ MMC. FIG. 6 is a magnesium-iron-germanium reactive MMC composite microstructure.

FIG. 7 also illustrates the improvement in erosion resistance of a degradable Mg—$B_4C$ composition of the present invention (Tervalloy™ MMC with 149 micron D50 ceramic particles) as compared to the baseline cast iron materials used today, and also to a non-MMC degradable magnesium alloy.

FIG. 8 is a table that illustrates impingement erosion loss of dissolvable alloys, hardened grey cast iron, and dissolvable magnesium metal matrix composite at different impingement angels.

DETAILED DESCRIPTION OF NON-LIMITING EMBODIMENTS OF THE INVENTION

Figure 1:
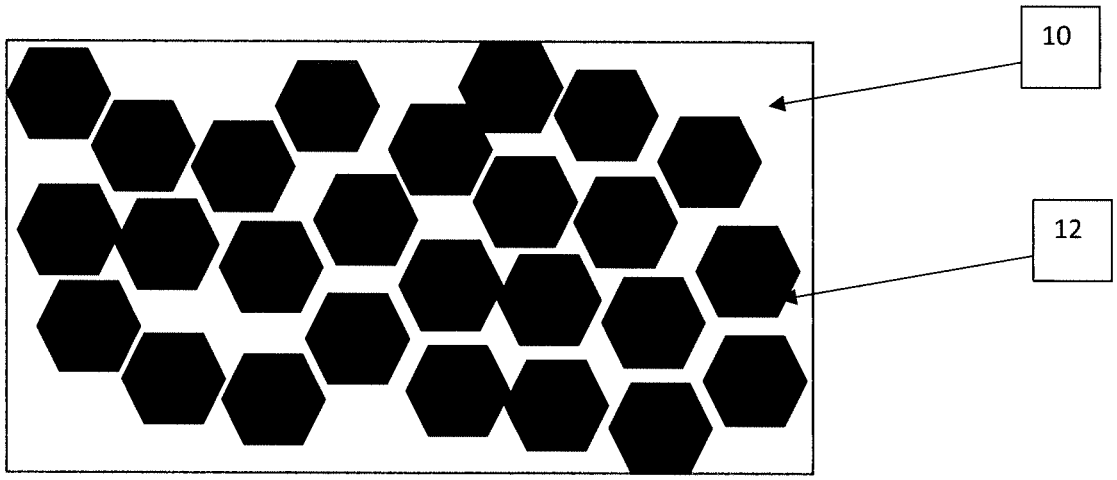
FIGS. 1-3 illustrate various non-limiting degradable metal matrix composite structures in accordance with the present invention. These figures illustrate the ceramic particles dispersed into a dissolvable metal matrix, generally at a concentration of 30-60 vol. %.

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations. In one non-limiting embodiment of the invention, the engineered degradable metal matrix composite includes a core material and a degradable binder matrix, and which composite includes the following properties: A) repeating ceramic particle core material of 20-90 vol. % of the composite; B) degradable metallic binder/matrix of 10-75 vol. % of the composite; C) galvanically-active phases formed in situ from a melt and/or added as solid particles that form 0.03-10 vol. % (and all values and ranges therebetween) of the composite; D) degradation rate being controlled to 0.1-5 mm/hr. in selected fluid environments including freshwater and brines at 35-200° C.; and E) hardness of the composite that exceeds 25 Rockwell C. The present inventions also relates to the method of manufacturing the engineered degradable metal matrix composite, which method includes the preparation of a plurality of ceramic particles, with or without galvanically-active materials such as, but not limited to, iron, nickel, copper, or cobalt, and infiltrating the ceramic particles with a degradable metal such as, but not limited to, magnesium or aluminum alloy. The invention also relates to the formation of high hardness, wear-, deformation-, and erosion-resistant metal matrix composite materials that exhibit controlled degradation rates in aqueous media at a temperature of at least 35° C., and typically about 35-200° C. (and all values and ranges therebetween) conditions. The ability to control the dissolution of a down hole well component in a variety of solutions is very important to the utilization of interventionless drilling, production, and completion tools such as sleeves, frac balls, hydraulic actuated tooling, scrapers, valves, screens, perforators and penetrators, knives, grips/slips, and the like.

The invention combines corrodible materials that include highly electronegative metals of magnesium, zinc, and/or aluminum, combined with a high hardness, generally inert phase such as SiC, $B_4C$, WC, $TiB_2$, $Si_3N_4$, TiC, $Al_2O_3$, $ZrO_2$, high carbon ferrochrome, $Cr_2O_3$, chrome carbide, or other high hardness ceramic, and a more electropositive, conductive phase generally selected from copper, nickel, iron, silver, lead, gallium, indium, tin, titanium, and/or carbon and their alloys or compounds. Tool steel, hard amorphous or semi-amorphous steel, and/or stellite alloy-type shards, shavings or particles can offer both galvanic and wear resistance. Other electronegative and electropositive combinations can be envisioned, but are generally less attractive due to cost or toxicity. The more electropositive phase should be able to sustain current, e.g., it should be conductive to drive the galvanic current. The ceramic phase is generally dispersed particles which are fine enough to be able to be easily removed by fluid flow and to not plug devices or form restrictions in a wellbore. It is generally accepted that particles having a size that is less than ⅛" are sufficient for this purpose, although most composites of the present invention utilize much finer particles, generally in the 100 mesh, and very often 200 or 325 mesh sizes, down to 2500 mesh (5 micron and below for increase hardness).

The ceramic or intermetallic, high hardness particles are dispersed in an electronegative metal or metal alloy matrix at concentrations at least 25 vol. %, and typically greater than 50 vol. % of the composite. Very high compressive strength and hardness can be achieved when sufficient ceramic volume has been obtained to limit the effects of the electropositive metal matrix on mechanical properties. This property can be obtained at lower ceramic content when using high aspect ratio particles, such as whiskers, flakes, platelets, or fibers, and substantial deformation resistance can be obtained with higher aspect ratio particles.

Because the generally inert ceramic phase (inert primarily due to low conductivity) inhibits corrosion rates, higher corrosion rate electronegative-electropositive alloy couples are generally used. For example, in a magnesium system, eliminating the addition of aluminum from the alloy (to make the matrix more electronegative), or shifting from copper additions to nickel or even iron (with carbon) additions can be used to increase corrosion rates. For example, using a freshwater or low temperature combination metal matrix (such as Terves FW) instead of a higher temperature brine dissolvable (such as TervAlloy™ TAx-100E and TAx-50E) can be used to sufficiently boost the corrosion rate of a 50 vol. % $B_4C$—Mg containing composite to reach 35 $mg/cm^2/hr.$ at 70-90° C. The addition of carbonyl iron particles to the magnesium alloy matrix can be used to form a useful lower temperature brine, or freshwater dissolvable metal matrix composite. Terves FW, TervAlloy™ TAx-100E and TAx-50E are magnesium or magnesium alloys with 0.05-5 wt. % nickel, and/or 0.5-10 wt. % copper additions. In one non-limiting embodiment, magnesium alloy includes over 50 wt. % magnesium and one or more metals selected from the group consisting of aluminum, boron, bismuth, zinc, zirconium, and manganese, and optionally 0.05-35 wt. % nickel, copper and/or cobalt. In another non-limiting embodiment, the magnesium alloy includes over 50 wt. % magnesium and one or more metals selected from the group consisting of aluminum in an amount of about 0.5-10 wt. %, zinc in amount of about 0.1-6 wt. %, zirconium in an amount of about 0.01-3 wt. %, manganese in an amount of about 0.15-2 wt. %; boron in amount of about 0.0002-0.04 wt. %, and bismuth in amount of about 0.4-0.7 wt. %, and optionally 0.05-35 wt. % nickel, copper and/or cobalt. In another non-limiting embodiment, the magnesium alloy includes over 50 wt. % magnesium and one or more metals selected from the group consisting of aluminum in an amount of about 0.5-10 wt. %, zinc in amount of about 0.1-3 wt. %, zirconium in an amount of about 0.01-1 wt. %, manganese in an amount of about 0.15-2 wt. %; boron in amount of about 0.0002-0.04 wt. %, and bismuth in amount of about 0.4-0.7 wt. %, and optionally 0.05-35 wt. % nickel, copper and/or cobalt. In another non-limiting embodiment, the magnesium alloy comprises at least 85 wt. % magnesium; one or more metals selected from the group consisting of 0.5-10 wt. % aluminum, 0.05-6 wt. % zinc, 0.01-3 wt. % zirconium, and 0.15-2 wt. % manganese; and optionally about 0.05-45 wt. % of a secondary metal selected from the group consisting of copper, nickel, cobalt, titanium and iron. In another non-limiting embodiment, the magnesium alloy composite comprises 60-95 wt. % magnesium; 0.01-1 wt. % zirconium; and optionally about 0.05-45 wt. % copper, nickel, cobalt, titanium and/or iron. In another non-limiting embodiment, the magnesium alloy comprises 60-95 wt. % magnesium; 0.5-10 wt. % aluminum; 0.05-6 wt. % zinc; 0.15-2 wt. % manganese; and optionally about 0.05-45 wt. % of copper, nickel, cobalt, titanium and/or iron. In another non-limiting embodiment, the magnesium alloy comprising 60-95 wt. % magnesium; 0.05-6 wt. % zinc; 0.01-1 wt. % zirconium; and optionally about 0.05-45 wt. % of copper, nickel, cobalt, titanium and/or iron. In another non-limiting embodiment, the magnesium alloy comprises over 50 wt. % magnesium; one or more metals selected from the group consisting of 0.5-10 wt. % aluminum, 0.1-2 wt. % zinc, 0.01-1 wt. % zirconium, and 0.15-2 wt. % manganese; and optionally about 0.05-45 wt. % of copper, nickel and/or cobalt. In another non-limiting embodiment, the magnesium alloy comprises over 50 wt. % magnesium; one or more metals selected from the group consisting of 0.1-3 wt. % zinc, 0.01-1 wt. % zirconium, 0.05-1 wt. % manganese, 0.0002-0.04 wt. % boron and 0.4-0.7 wt. % bismuth; and optionally about 0.05-45 wt. % of copper, nickel, and/or cobalt. In another non-limiting embodiment, the magnesium alloy comprises 60-95 wt. % magnesium and 0.01-1 wt. % zirconium. In another non-limiting embodiment, the magnesium alloy comprises over 50 wt. % magnesium and one or more metals selected from the group consisting of aluminum in an amount of about 0.5-10 wt. %, zinc in amount of about 0.1-3 wt. %, zirconium in an amount of about 0.01-1 wt. %, manganese in an amount of about 0.15-2 wt. %, boron in amount of about 0.0002-0.04 wt. %, and bismuth in amount of about 0.4-0.7 wt. %.

Figure 4:
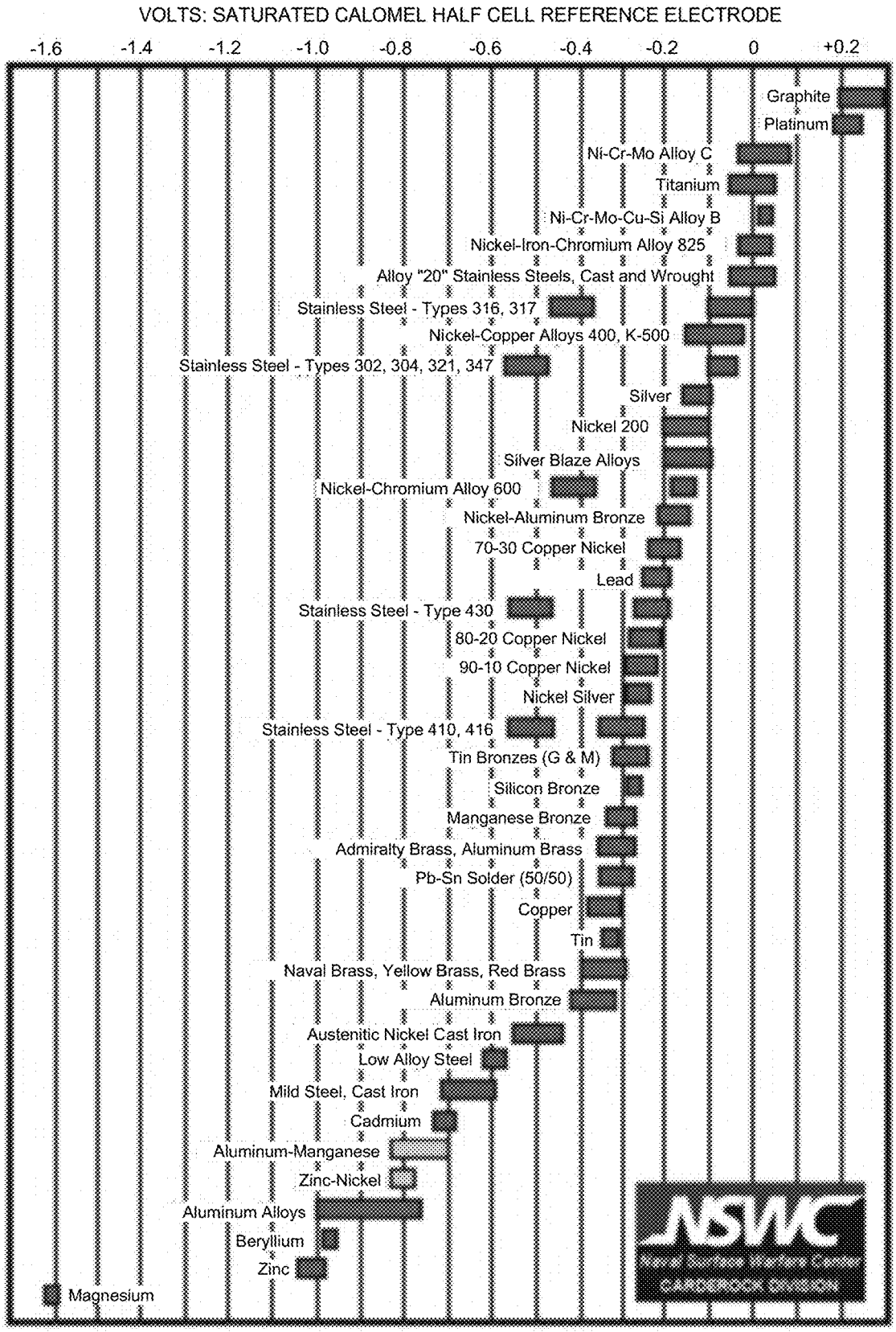
FIG. 4 is a chart illustrating the galvanic series showing electronegative materials. Magnesium is a very electronegative material and undergoes active corrosion when coupled with a variety of metals. Particularly effective are iron, nickel, copper, and cobalt, as well as $Fe_3Al$ since they do not form insulating oxides under typical conditions and, as such, maintain electrical connectivity with the fluid. Dissolution rates are controlled by the amount and size of these additives, driven by the electrically connected surface area of the positive and negative metals in the galvanic series.

The electropositive driving phase can be added by adding soluble or insoluble electropositive particles to the ceramic powder prior to melt infiltration or mixing into a melt by adding the electropositive material as a coating or cladding to the inert ceramic phase, or by adding as an alloying element that forms a fully liquid phase with the electropositive metal or alloy. In the liquid phase, generally an electropositive metal that forms a eutectic with the electronegative metal and an intermetallic of the electropositive metal can be used. Non-limiting examples of such coatings or claddings are Mg—Ni, Mg—Cu, Mg—Co, and Mg—Ag. FIG. 4 is a chart illustrating the galvanic series showing electronegative materials (magnesium through cadmium, electronegative being more electronegative than steel), and electropositive metals (steel through carbon).

The electropositive driving phase can also be added to electropositive metal powders, along with the ceramic phase, and the dissolvable MMC fabricated from powder metallurgy or spray consolidation techniques such as press and sinter, hot isostatic pressing, spark plasma sintering, powder sinter-forging, direct powder extrusion, thermal spray, cold spray, plasma spray, or other powder consolidation techniques.

For melt infiltration of a ceramic preform or powder bed, techniques that can be used include pressureless infiltration (when the ceramic and electronegative metal wet each other, or when the ceramic has been coated with a wetting phase such as a eutectic forming or other easily wet metal), or pressure-assisted infiltration technique such as squeeze casting, high pressure die casting (into the ceramic preform), vacuum casting, or pressure-assisted casting techniques, among others. Particularly at lower ceramic volumes (25-50 vol. %), the particles can be stir-cast, thixocast, or slurry cast by mixing the ceramic (and electropositive material, if in powder form) and formed in the liquid plus ceramic or semi-solid state. Net shape or near net shape fabrication techniques are preferred due to machining cost of precision grinding of the high hardness materials. Active wetting metals such as titanium, zirconium, vanadium, niobium, silicon, boron, and palladium can be added to the melt system to enhance wetting. Surface wetting coatings, often eutectic liquid formers such as niobium, zirconium, magnesium, aluminum, silicon, and/or bismuth can provide strong wetting ability to enhance pressureless infiltration.

After consolidation, the compact can be further formed by forging, extrusion, or rolling. The compact can also be taken back to an elevated temperature, normally in the semi-solid region between the electropositive alloy liquidus and solidus, and formed using closed die forming, squeeze casting, thixocasting, or other semi-solid forming technique.

The cast or formed part can be machined to close tolerances using grinding or electrode discharge machining (EDM). Diamond, CBN, and other high hardness tools can also be used.

The degradable metal matrix composite can be applied as a coating, such as by cold spray, to a separate part, to impart wear-, erosion-, or deformation-resistance, or to slow initial dissolution rates to give added life. A higher degradation rate core is generally desired. In one embodiment, the MMC can be created by surface alloying the higher degradation rate, or lower hardness core, with the ceramic phase by such techniques as friction stir surfacing, supersonic particle spray, or reactive heat treatments (such as boronizing). Other routes to a dual structured component include overcasting or overmolding, or physical assembly with or without an adhesive or bonding step such as forging, hot pressing, friction welding, or use of adhesives.

After machining, parts may be further coated or modified to control initiation of dissolution or to further increase hardness or ceramic content. Techniques such as cold spray, thermal spray, friction surfacing, powder coating, anodizing, painting, dip coating, e-coating, etc. may be used to add a surface coating or otherwise modify the surface.

The degradable MMCs of the present invention are particularly useful in the construction of downhole tools for oil and gas, geothermal, and in situ resource extraction applications. The higher hardness enables tools such as reamers, valve seats, ball seats, and grips to be engineered to be fully degradable, eliminating debris as well as the need to retrieve or drill-out the tools. The degradable MMC is a useful, degradable substitute for hardened cast iron in applications such as plug seats and gripping devices for bridge and frac plugs. The degradable MMC is also useful for the design and production of cement plugs, reamers, scrapers, and other devices.

The deformation resistance of the degradable MMCs allows the construction of higher pressure rating valve and plug systems than non-MMC degradable products. For example, a degradable MMC frac ball can withstand 15,000 psi across a 1/16" seat overlap compared to less than 7,000 psi for a conventional degradable magnesium alloy or polymer ball.

Figure 2:
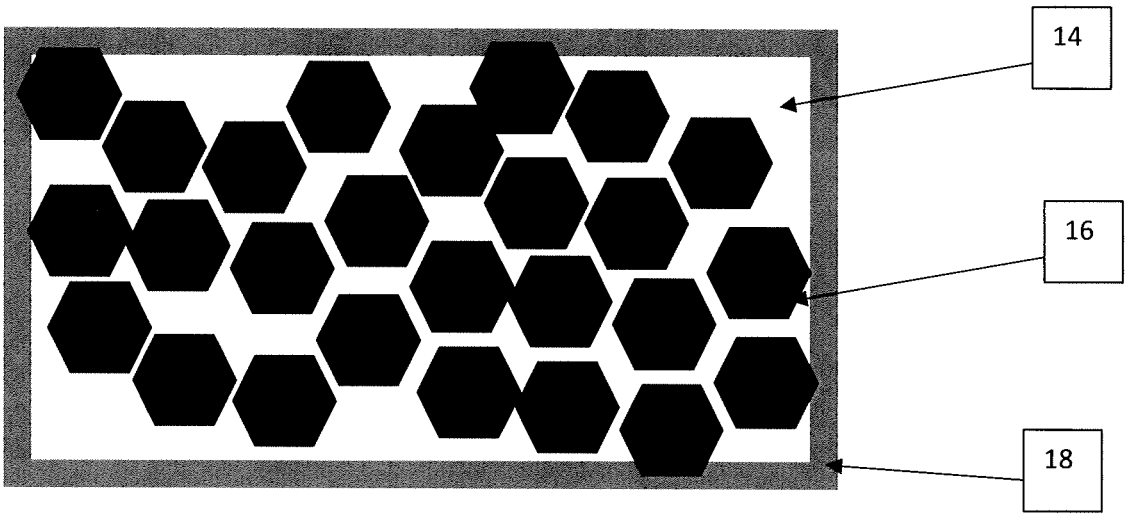
Figure 3:
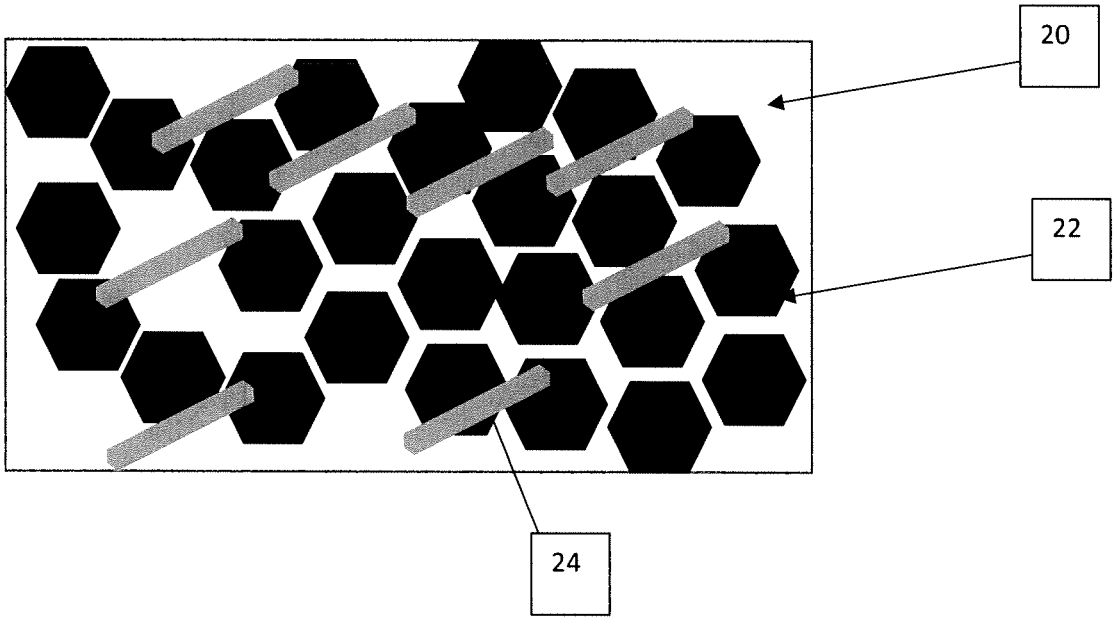

FIGS. 1-3 illustrate various degradable metal matrix composite structures in accordance with the present invention. FIGS. 1-3 illustrate a composite formed of ceramic particles 12 in a dissolvable metallic matrix 10.

The composite material is formed by 1) providing ceramic particles, 2) providing a galvanically-active material such as iron, nickel, copper, titanium, and/or cobalt, 3) combining the ceramic particles and galvanically-active material with molten matrix material such as molten magnesium, molten aluminum, molten magnesium alloy or molten aluminum alloy, and 4) cooling the mixture to form the composite material. The cooled and solid dissolvable metallic matrix generally includes over 50 wt. % magnesium or aluminum. The ceramic material is generally coated with the galvanically-active material prior to adding the motel matrix material; however, this is not required.

The galvanically-active material coating on the ceramic material, when precoated, can be applied by any number of techniques (e.g., vapor deposition, dipping in molten metal, spray coating, dry coated and then heated, sintering, melt coating technique, etc.). Generally, each of the coated ceramic particles are formed of 30-98 wt. % ceramic material (and all values and ranges therebetween), and typically greater than 50 wt. % ceramic material. The thickness of the galvanically-active material coating is generally less than 1 mm, and typically less than 0.5 mm.

After the composite is formed, the ceramic material constitutes about 10-85 wt. % (and all values and arranges therebetween) of the composite, the galvanically-active material constitutes about 0.5-30 wt. % (and all values and arranges therebetween) of the composite, and the molten matrix material constitutes about 10-85 wt. % (and all values and arranges therebetween) of the composite.

The dissolution rate of the composite is at least 5-800 $mg/cm^2/hr.$, or equivalent surface regression rates of 0.05-5 mm/hr. at a temperature of 35-200° C. in 100-100,000 ppm water or brines, and typically at least 45 $mg/cm^2/hr.$ in 3 wt. % KCl water mixture at 90° C., more typically up to 325 $mg/cm^2/hr.$ in 3 wt. % KCl water mixture at 90° C.

FIG. 2 illustrates the composite surrounded by a protective coating 18 (e.g., degradable polymer material, degradable metal). The protective coating can be formulated to dissolve or degrade when exposed to one or more activation or trigger conditions such as, but not limited to, temperature, electromagnetic waves, sound waves, certain chemicals, vibrations, salt content, electrolyte content, magnetism, pressure, electricity, and/or pH. Once the protective coating has sufficiently dissolved or degraded, the composite is then exposed to the surrounding fluid, thus causing the composite to dissolve, corrode, etc. when exposed to certain surrounding conditions. The protective coating can be formed of one or more metal and/or polymer layers. Non-limiting polymer protective coatings that can be used include ethylene-α-olefin copolymer; linear styrene-isoprene-styrene copolymer; ethylene-butadiene copolymer; styrene-butadiene-styrene copolymer; copolymer having styrene endblocks and ethylene-butadiene or ethylene-butene midblocks; copolymer of ethylene and alpha olefin; ethylene-octene copolymer; ethylene-hexene copolymer; ethylene-butene copolymer; ethylene-pentene copolymer; ethylene-butene copolymer; polyvinyl alcohol (PVA); silicone, and/or polyvinyl butyral (PVB). The thickness of the protective coating is generally less than 3 mm, and more typically about 0.0001-1 mm.

FIG. 3 illustrates a composite formed of degradable matrix 20 with ceramic particles 22 and platelet or fiber mechanically-reinforced flakes, platelets, or fibers 24. The platelets or fibers typically have an aspect ratio of at least 4:1, and typically 10:1 or more. The length of the platelets or fibers is generally less than 3 mm, and typically less than 2 mm. The platelets or fibers, when used, are generally formed of boron carbide silicon carbide, and/or graphite; however, other materials can be used.

EXAMPLES

In one embodiment, the reactivity of an electrolytically activated reactive composite of magnesium or zinc and iron with ceramic reinforcements is controlled to produce a dissolution rate of 1-10 mm/day (and all values and ranges therebetween), or 0.5-800 $mg/cm^2/hr.$ (and all values and ranges therebetween) (depending on density) by controlling the relative phase amounts and interfacial surface area of the two galvanically-active phases. In one example, a mechanical mixture of iron or graphite and magnesium is prepared by mechanical milling of magnesium or magnesium alloy powder and 40 vol. % of 30-200 micron iron graphite (and all values and ranges therebetween) graphite or 10 wt. % nickel-coated graphite particles, followed by consolidation using spark plasma sintering or powder forging at a temperature below the magnesium or zinc melting point. The resultant structure has an accelerated rate of reaction due to the high exposed surface area of the iron or graphite cathode phase, but low relative area of the anodic (zinc or magnesium) reactive binder.

Figure 5:
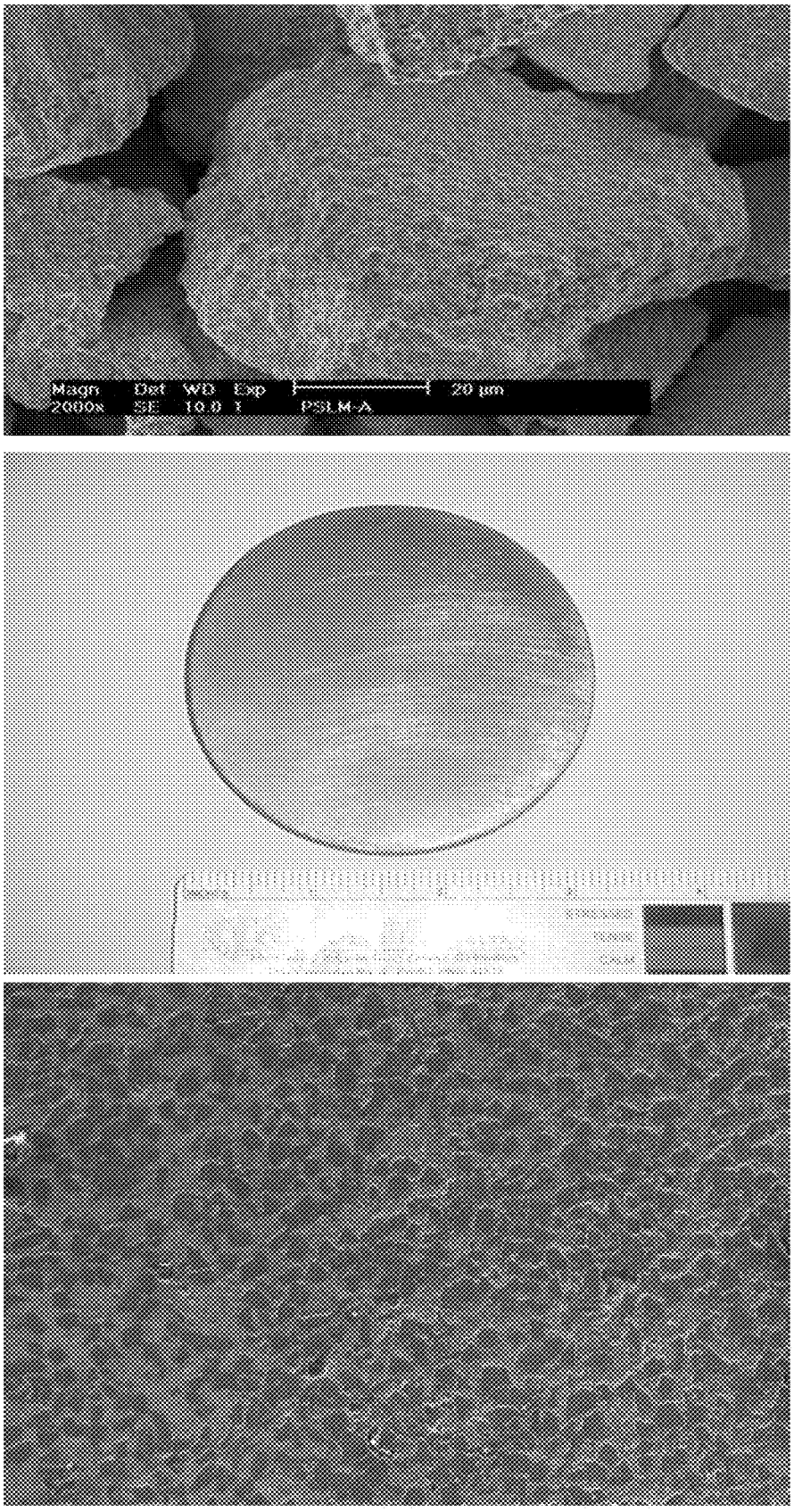
FIGS. 5 and 6 illustrate a representative microstructure for a magnesium-graphite composite that is galvanically active and could be used as a low friction or deformation-resistant structure, but is not generally effective for wear resistance.
Figure 6:
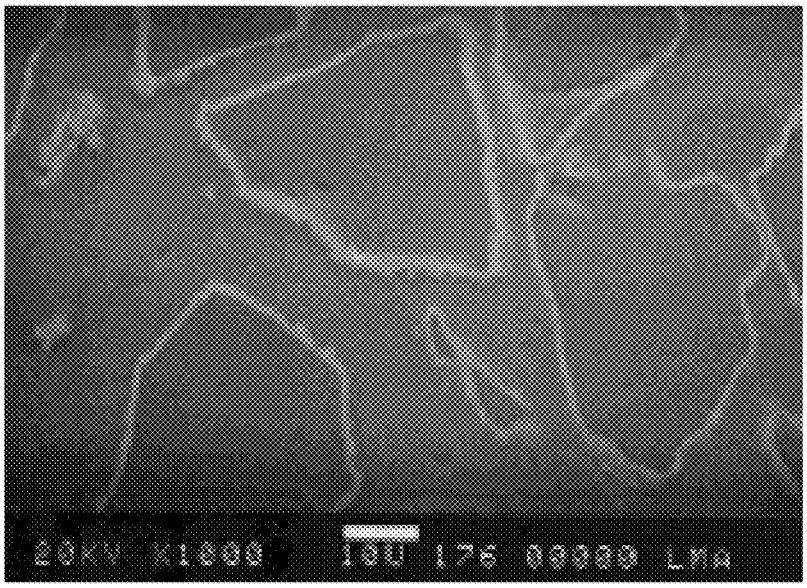
Figure 7:
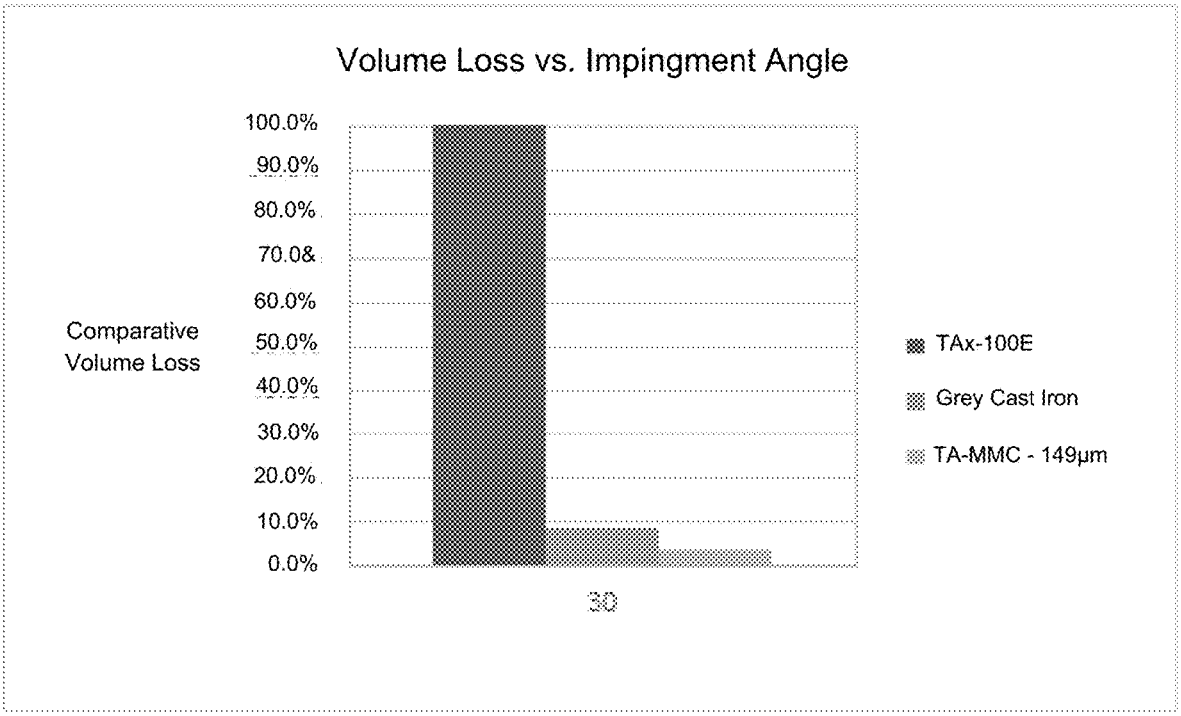
FIG. 7 illustrates the comparative impingement loss at 30° impact angle of a typical seat versus material.

The degradable MMC can be used for powder metallurgical processing. FIGS. 5 and 6 illustrate a representative microstructure for a magnesium-graphite composite.

In general, larger ceramic particles, typically above 40 mesh, including flake, impart great impingement erosion resistance at higher angels, while smaller particles, typically below 200 mesh, provide higher sliding wear resistance. Larger particles can also facilitate gripping (in frac plug grips/slips, to facilitate locking a device to a mating surface), such as when mm-sized crushed carbides are added to a dissolvable matrix. Such embedded metal matrix composites can also be used in reamer-type applications as abrasives, such as by adding larger chunks or even preformed shapes, such as crushed, machined, or formed carbides or tool steel discreet elements.

Example 1

Boron carbide powder with an average particle size of 325 mesh is surface modified by the addition of zinc by blending 200 grams of $B_4C$ powder with 15 grams of zinc powder and heated in a sealed, evacuated container to 700° C. to distribute the zinc to the particle surfaces. The zinc-coated $B_4C$ powder is placed into a graphite crucible and heated to 500° C. with an inert gas cover. In a separate steel crucible, 500 grams of Terves FW low temperature dissolvable degradable magnesium alloy is melted to a temperature of 720° C. The degradable magnesium alloy is poured into the 8-inch deep graphite crucible containing the zinc-coated $B_4C$ particles sufficient to cover the particles by at least two inches and allowed to solidify.

The material had a hardness 52 Rockwell C, and a measured dissolution rate of 35 mg/cm$^2$/hr. in 3 vol. % KCl at 90° C.

Example 2

300 g of 600 mesh boron carbide powder was placed to a depth of 4"×2" diameter by ten-inch deep graphite crucible containing a two inch layer of ¼" steel balls (600 g of steel) covered by a 325 mesh steel screen and heated to 500° C. under inert gas. The graphite crucible was heated inside of a steel tube, which was heated with the crucible. Five pounds of Terves FW degradable magnesium alloy were melted in a steel crucible to a temperature of 730° C. and poured into the graphite crucible sufficient to cover the $B_4C$ and steel balls to reach within two inches of the top of the graphite crucible. The crucible was removed from the furnace and transferred to a 12-ton carver press, where a die was rammed into the crucible forcing the magnesium into and through the powder bed. The crucible was removed from the press and allowed to cool.

The MMC section was separated from the non-MMC material and showed a dissolution rate of 45 gm/cm$^2$/hr. at 90° C. in 3 vol. % KCl solution. The measured hardness was 32 Rockwell C.

Example 3

125 grams of 325 mesh $B_4C$ powder was blended with 4 grams of 100 mesh titanium powder and sintered at 500° C. to form a rigid preform. A 500 gram ingot of TAx-50E dissolvable metal alloy was placed on top of the preform in a graphite crucible. The crucible was placed in the inert gas furnace and heated to 850° C. for 90 minutes to allow for infiltration of the preform. The infiltrated preform had a hardness of 24 Rockwell C.

Example 4

Degradable MMC from Example 3 was machined into a frac ball. A 3" ball (3.000+/−0.002), when tested against a cast iron seat with a 45° seat angle and inner diameter of 2.896", was shown to hold greater than 15,000 psig pressure at room temperature. The degradable magnesium frac ball was machined from a high dissolution rate dissolving alloy having a dissolution rate of greater than 100 mg/cm$^2$/hr. at 90° C. The frac ball was undermachined by 0.010", to 2.980+/−0.002, and the degradable MMC was applied using cold spray application from a powder generated by ball milling 400 grams of standard degradable alloy machine chips with 600 grams 325 mesh of $B_4C$ powder using a centerline Windsor SST cold spray system and nitrogen gas as the carrier gas. The ball was then machined to 3"+/−0.002". The ball held >10,000 psig against a 45° cast iron seat at 2.875" inner diameter. The frac ball was designed to give two hours of operating time, before dissolving rapidly in less than 48 hours at 90° C. in 3% KCl brine solution.

Example 5

Degradable MMC from Example 3 was machined into a frac ball except that TAx-100E was used instead of TAx-50E. The TAx-100E included trace amounts of iron to form a composite having a hardness of 74 HRB and a dissolution rate of 34 mg/cm$^2$/hr. in 3% vol. % KCl at 90° C. during a six-hour test. 125 grams of 325 mesh $B_4C$ powder was blended with 4 grams of 100 mesh titanium powder and sintered at 500° C. to form a rigid preform. A 500 gram ingot of TAx-100E with 0.1% iron was placed on top of the preform in a steel crucible. The crucible was placed in the inert gas furnace and heated to 850° C. for 90 minutes to allow for infiltration of the preform. The infiltrated preform had a hardness of 74 HRB and a dissolution rate of 34 mg/cm$^2$/hr. in 3% KCl at 90° C. during six hours of brine exposure.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A degradable composite including:

a. plurality of ceramic or intermetallic particles having a hardness greater than 50 HRC;

b. galvanically-active elements that include one or more elements selected from the group consisting of iron, nickel, copper, cobalt, titanium silver, gold, gallium, bismuth, palladium, carbon, or indium; and c. degradable metal matrix that includes magnesium, aluminum, magnesium alloy or aluminum alloy, said degradable alloy matrix constituting greater than 50 wt. % magnesium or greater than 50 wt. % aluminum;

wherein said degradable composite material includes a plurality of degradation catalyst particles, zones, or regions that are galvanically-active; and wherein said ceramic or intermetallic particles were pre-coated with said galvanically-active elements prior to being combined with said degradable metal matrix; and wherein a content of said plurality of ceramic or intermetallic particles in said degradable composite is 20 vol. % to 90 vol. % of said degradable composite; and wherein said degradable composite has a hardness of greater than 22 Rockwell C; and wherein said degradable composite has a degradation rate of 0.02-5 mm/hr. at 35-200° C. in 100-100,000 ppm freshwater or brine.

2. The degradable composite as defined in claim 1, wherein the ceramic or intermetallic particles include one or more materials selected from the group consisting of metal carbides, borides, oxides, silicides, or nitrides such as $B_4C$, $TiB_2$, TiC, $Al_2O_3$, MgO, SiC, $Si_3N_4$, $ZrO_2$, $SiB_6$, SiAlON, and WC.

3. The degradable composite as defined in claim 1, wherein the ceramic or intermetallic particles have a particle size of 0.1-1000 microns.

4. The degradable composite as defined in claim 1, wherein at least a portion of the ceramic or intermetallic particles are shards, fragments, preformed or machined shapes, or flakes with a maximum dimension of 0.1-4 mm.

5. The degradable composite as defined in claim 1, wherein a material used to precoat said ceramic or intermetallic particles is selected from the group consisting of nickel, iron, cobalt, and copper.

6. The degradable composite as defined in claim 1, wherein a material used to precoat said ceramic or intermetallic particles is selected from the group consisting of magnesium, zinc, aluminum, and tin.

7. The degradable composite as defined in claim 1, wherein a material used to precoat said ceramic or intermetallic particles is selected from the group consisting of titanium, zirconium, niobium, vanadium, and chromium.

8. The degradable composite as defined in claim 1, wherein said degradable alloy matrix includes one or more active metals selected from the group consisting of calcium, barium, indium, gallium, lithium, sodium, and potassium.

9. The degradable composite as defined in claim 1, wherein the degradation rate of said degradable composite is 0.02-5 mm/hr. in freshwater or brines at a temperature of 35-200° C.

10. The degradable composite as defined in claim 1, wherein the degradation rate of said degradable composite is 0.02-5 mm/hr. in a brine composition with a total dissolved solids of 300-300,000 ppm of chloride, bromide, formate, or carbonate brines at a temperature of 35-200° C.

11. The degradable composite as defined in claim 1, wherein a compression strength of said degradable composite is greater than 40 ksi.

12. The degradable composite as defined in claim 1, wherein the compressive strength of said degradable composite is greater than 100 ksi.

13. The degradable composite as defined in claim 1, wherein said degradable composite is fabricated by powder metallurgy, melt infiltration, or squeeze casting to create a greater than 92% pore-free structure.

14. The degradable composite as defined in claim 1, wherein said degradable composite has been deformed and/or heat treated to develop improved mechanical properties, reduce porosity, or to form net shape or near net shape dimensions.

15. The degradable composite as defined in claim 1, wherein the degradable composite is used as a degradable structure useful in oil and gas or other subterranean operations, said degradable structure including a seat, seal, ball, frac ball, cone, wedge, insert for a slip, sleeve, valve, frac seat, sleeve, grip, slip, valve, valve component, spring, retainer, scraper, poppet, penetrator, perforator, shear, blade, frac plug, or insert.

16. The degradable composite as defined in claim 1, wherein said degradable composite is used to form at least a portion of a component such as a surface coating or cladding, an insert, sleeve, ring, or other limited volume portion of a component or system.

17. The degradable composite as defined in claim 1, wherein said degradable composite is applied to a component surface through a cold spray, thermal spray, or plasma spray process.

18. The degradable composite as defined in claim 1, wherein said degradable composite is fabricated using pressure-assisted or pressureless infiltration of a bed of ceramic particles, where the galvanic catalyst, dopant, or phase is formed in situ, ex situ, and/or formed in situ prior to or during infiltration or composite preparation.

19. The degradable composite as defined in claim 1, wherein said degradable composite is fabricated through powder metallurgy processes, including mixing or powders, compacting, and sintering, or alternate isostatic pressing, spark plasma sintering, powder forging, injection molding, or similar processes to produce the desired composite.

20. The degradable composite as defined in claim 1, wherein said degradable composite contains flakes, platelets, whiskers, or short fibers with an aspect ratio of at least 4:1.

21. The degradable composite as defined in claim 1, wherein said degradable composite includes a hollow area in the interior of the degradable composite, said hollow area i) is absent material to reduce the weight of the degradable composite, or ii) contains a catalyst material that accelerates or catalyzes dissolution of the degradable composite, and wherein said catalyst material is a solid acid, trigger chemical, salt, or other chemical capable of accelerating degradation of the degradable composite.

22. A degradable composite including:

a. a plurality of ceramic or intermetallic particles having a hardness greater than 50 HRC, said ceramic or intermetallic particles having a particle size of 0.1-1000 microns;

b. galvanically-active elements that include one or more elements selected from the group consisting of calcium, barium, lithium, sodium, potassium, iron, nickel, copper, cobalt, titanium silver, gold, gallium, bismuth, lead, palladium, carbon, and indium; and c. a degradable metal matrix that includes i) a magnesium alloy that includes greater than 50 wt. % magnesium, or ii) an aluminum alloy that includes greater than 50 wt. % aluminum;

wherein said plurality of ceramic or intermetallic particles and said galvanically-active elements are dispersed in said degradable metal matrix;

wherein said degradable composite includes a plurality of degradation catalyst particles, zones, or regions that are galvanically-active; and wherein said ceramic or intermetallic particles were precoated with said galvanically-active elements prior to being combined with said degradable metal matrix; and wherein said composite including at least 10 vol. % degradable metal matrix, at least 0.03 vol. % galvanically-active elements, and at least 10 vol. % ceramic or intermetallic particles; and wherein said degradable composite having a hardness of greater than 22 Rockwell C; and wherein said degradable composite has a degradation rate of at least 5 mg/cm$^2$/hr. at 35° C. in 100-100,000 ppm freshwater or brine.

23. The degradable composite as defined in claim 22, wherein said ceramic or intermetallic particles include one or more materials selected from the group consisting of $B_4C$, $TiB_2$, TiC, $Al_2O_3$, MgO, SiC, $Si_3N_4$, $ZrO_2$, $ZrSiO_4$, $SiB_6$, SiAlON, WC, carbon ferrochrome, $Cr_2O_3$, and chrome carbide.

24. The degradable composite as defined in claim 22, wherein said degradable composite has a hardness of greater than 30 Rockwell C.

25. The degradable composite as defined in claim 22, wherein said ceramic or intermetallic particles are surface coated with a metal prior to be mixed with said degradable metal matrix, said metal including one or more materials selected from the group consisting of nickel, zirconium, niobium, vanadium, chromium, iron, cobalt, titanium, copper, magnesium, zinc, aluminum, tin, and titanium, said coating having a thickness of 60 nm to 100 microns.

26. The degradable composite as defined in claim 22, wherein said degradable metal matrix is a magnesium alloy that includes greater than 50 wt. % magnesium, said magnesium alloy including one or more metal additive selected from the group consisting of nickel, copper, aluminum, boron, bismuth, zinc, zirconium, cobalt, manganese, titanium, and iron.

27. The degradable composite as defined in claim 22, wherein said degradable composite is coated a protective coating, said protective coating is less than 3 mm, said protective coating including a polymer layer.

28. The degradable composite as defined in claim 22, wherein said degradable composite further includes flakes, fibers or platelets, said flakes fibers or platelets have an aspect ratio of at least 4:1, a length of said flakes, fibers or platelets is up to 4 mm, said flakes, fibers or platelets including one or more materials selected from the group consisting of boron carbide, silicon carbide, and graphite.

29. The degradable composite as defined in claim 22, wherein a compression strength of said degradable composite is greater than 40 ksi.

30. The degradable composite as defined in claim 22, wherein said degradable composite is formed partially or fully into a structure useful in oil and gas or other subterranean operations, said structure including a seat, seal, ball, frac ball, cone, wedge, insert for a slip, sleeve, valve, frac seat, sleeve, grip, slip, valve, valve component, spring, retainer, scraper, poppet, penetrator, perforator, shear, blade, and insert.

* * * * *